US008336989B2

(12) United States Patent
Mizutani et al.

(10) Patent No.: US 8,336,989 B2
(45) Date of Patent: Dec. 25, 2012

(54) INK JET RECORDING APPARATUS

(75) Inventors: Michinari Mizutani, Kawasaki (JP); Takuma Kodoi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1329 days.

(21) Appl. No.: 11/755,311

(22) Filed: May 30, 2007

(65) Prior Publication Data

US 2008/0043055 A1 Feb. 21, 2008

(30) Foreign Application Priority Data

Jun. 21, 2006 (JP) ..... 2006-170977

(51) Int. Cl.
*B41J 2/165* (2006.01)

(52) U.S. Cl. ..... 347/36; 347/31

(58) Field of Classification Search ..... 347/31, 347/36, 30, 34
See application file for complete search history.

(56) References Cited

U.S. PATENT DOCUMENTS

| | | | | |
|---|---|---|---|---|
| 6,280,513 | B1 | 8/2001 | Osumi et al. | |
| 6,375,305 | B2 | 4/2002 | Sugimoto et al. | |
| 6,425,662 | B1 | 7/2002 | Teraoka et al. | |
| 6,623,099 | B2 | 9/2003 | Matsumura | |
| 7,445,312 | B2 * | 11/2008 | Komatsu et al. | 347/31 |

FOREIGN PATENT DOCUMENTS

| | | |
|---|---|---|
| JP | 2000-063719 | 2/2000 |
| JP | 2000-127439 | 5/2000 |
| JP | 2000-198955 | 7/2000 |
| JP | 2000-198956 A | 7/2000 |
| JP | 2001-001553 A | 1/2001 |
| JP | 2001-105626 | 4/2001 |
| JP | 2002-225312 | 8/2002 |
| JP | 2003-165236 A | 6/2003 |
| JP | 2005-161750 A | 6/2005 |

* cited by examiner

*Primary Examiner* — Kevin S Wood
(74) *Attorney, Agent, or Firm* — Fitzpatrick, Cella, Harper & Scinto

(57) ABSTRACT

An object of the present invention is to provide an ink jet recording apparatus which can keep an adequate absorptivity of an ink absorbing member for a long period of time, even when such inks which react with each other are sucked through the same cap in a sucking recovery operation, by preventing a mixed ink collected by the ink absorbing member from thickening or being solidified. The ink jet recording apparatus has: a recovery unit 8 and 62 for draining ink from a black-ink discharge portion 13 for discharging black ink and a color-ink discharge portion 14 for discharging color ink which reacts with the black ink; an ink absorbing member 31 for collecting the ink which is drained by the recovery unit and separating the ink into a solid part 41 and a liquid part 42; and an ink introduction unit 7 for introducing the ink which is drained by the recovery unit, into the ink absorbing member.

12 Claims, 16 Drawing Sheets

INK JET RECORDING APPARATUS

BACKGROUND OF THE INVENTION

1. Field of the Invention

The present invention relates to an ink jet recording apparatus which discharges ink from a recording head on the basis of image information to record an image, and specifically relates to the ink jet recording apparatus provided with an ink collecting mechanism for collecting ink drained from a recovery unit.

2. Description of the Related Art

A recording apparatus is used for a recording apparatus having a function such as a printer, a copying machine and a facsimile; multifunction equipment including a computer and a word processor; or output equipment of a workstation. The recording apparatus is composed so as to record an image on a recording medium such as paper and a plastic sheet, on the basis of image information. The recording apparatus can be classified into an ink jet printing type, a wire dot printing type, a hot printing type, a thermal printing type and a laser beam printing type, according to a recording system. A recording apparatus can be also classified into a serial type and a line type according to a scanning system. The serial type recording apparatus records an image by combining horizontal scanning which moves a recording head along a recording medium, and vertical scanning which feeds the recording medium. The line type recording apparatus records the image only by vertical scanning in a conveying direction of the recording medium, while recording information corresponding to one line by one operation with the use of a recording head stretching in the cross direction of the recording medium.

An ink jet printing type recording apparatus (ink jet recording apparatus) discharges ink from an ink jet recording head to a recording medium on the basis of image information to record an image. The ink jet recording apparatus has advantages such as a low noise level, a low running cost and easiness of being miniaturized and of being colored, and accordingly is widely applied to a printer, a facsimile and a copying machine. The recording head which is used as a recording unit in an ink jet recording apparatus is provided with a discharge port (in general, an end opening of a nozzle) for discharging ink. The ink jet recording apparatus drives the recording head and makes it discharge an ink droplet from the discharge port in response to a discharge signal based on recorded data sent from a host device such as a personal computer in general. The discharge port (or the nozzle) has a diameter of several tens of micrometers for instance, when being circular, and is further refined and densified as a picture quality of the recording image becomes higher in recent years. Such a recording head is required, for instance, to print a denser black character and the like, print colors, print a finer image (higher resolution) and have improved water resistance, as the quality of the recording image becomes higher in recent years.

In general, a serial type of the ink jet recording apparatus mounts a recording head on a carriage, and records an image by making the recording head discharge ink according to the reciprocating movement of the carriage and form a dot on a recording medium. An example of the recording head in the serial type of the ink jet recording apparatus, which inexpensively satisfies the requirement for enhancing the quality of a recorded image, includes the one having a configuration shown in FIG. 3, which will be described later as an embodiment. Specifically, the recording head 3 configures a discharge port array 13 for black ink, a discharge port array 14 for yellow ink, a discharge port array 15 for magenta ink and a discharge port array 16 for cyan ink on a common discharge face 17 of the recording head 3 in parallel to the scanning direction of the recording head. In the above configuration, discharge ports in each discharge port array are arranged at a pitch corresponding to 600 dpi (dot per inch) along with the tendency of high accuracy, and further at a pitch corresponding to even 1200 dpi. The pitches between the respective discharge port arrays are also decreased so as to miniaturize the recording head and consequently the apparatus.

Incidentally, there is a recording head capable of coping with high quality recording, which employs inks that cause a chemical reaction, for instance, between black ink and other color ink and insolubilize a dye or the like by the chemical reaction, in order to improve water resistance and prevent blur between colors. Specifically, for instance, the black ink has a cationic property and the other color ink has an anionic property. In addition, Japanese Patent Application Laid-Open No. 2000-063719 discloses the ink which employs an ink composition using a pigment as a coloring material and a reaction liquid for making the coloring material in the ink composition unstable, makes the coloring material coagulate by using the reaction between the two liquids, and inhibits the ink from causing the blur or color mixture (bleeding) on plain paper. In addition, Japanese Patent Application Laid-Open No. 2000-198955 discloses the ink and ink set which employs a pigment as a coloring material, further adds a particular salt into the ink, and inhibits the bleeding.

In recent years, ink containing a pigment component as black ink has been commonly used so as to improve the quality of a black character used in a text document or the like.

Incidentally, an ink jet recording apparatus records an image by discharging ink from a fine discharge port, so that the state of the ink in the vicinity of the discharge port tends to be affected by an environment factor such as humidity. For instance, the ink can be solidified and fixed by drying. Then, ink cannot be discharged at regular timing, which deteriorates image quality. For this reason, this type of the ink jet recording apparatus is provided with a cap which closely contacts a discharge face (face having discharge ports arrayed thereon) of a recording head to seal the discharge port (to intercept it from outer air). In the case of a serial type of a recording apparatus, the cap is arranged at a predetermined position (for instance, a home position of the recording head) outside the recording area. Thus, the recording apparatus prevents the ink in the discharge port (in a nozzle) from thickening and being solidified through evaporating and being dried while the recording apparatus is not printing.

On the other hand, an ink jet recording apparatus may cause clogging in a discharge port. In order to prevent the clogging, ink is sucked (drained) from the discharge port through a cap by using a negative pressure source such as a sucking pump, which is a sucking recovery operation. In other words, the ink is forcefully sucked from the discharge port, by the operation of connecting the sucking pump to the cap and operating the sucking pump in a state of being capped to form a negative pressure in the cap. The operation replaces the ink in the discharge port with a new ink, and consequently can prevent or resolve (recovered) the clogging in the discharge port. A usable pump for generating the negative pressure includes a piston-cylinder-type pump or a tube pump, for instance. The piston-cylinder-type pump uses the movement of the piston in a cylinder. The tube pump generates the negative pressure in the tube by squeezing the elastic tube connected to the cap with a roller and using the returning force of the elastic tube.

An ink jet recording apparatus also wipes a discharge face with a wiper such as a rubber blade in order to remove a foreign material such as ink and dirt depositing on the discharge face. The ink jet recording apparatus also replaces the ink in the discharge port with a flesh ink, by discharging an ink that is not directed at recording to an ink sump from the discharge port, which is a preliminary discharge operation. The ink jet recording apparatus keeps or recovers an ink-discharging performance of a recording head by the above described sucking operation, wiping operation and preliminary discharge operation, which is recovery treatment.

Various researches and developments have proceeded on properties of ink in order to respond to the requirement of high-resolution recording. A first developed ink for inhibiting the ink from causing blur and color mixture (bleeding) on a recording medium of plain paper or the like is an ink showing such properties as the black ink and the color ink for forming a recording image react with each other, and are solidified or thickened. Such a type of ink may be thickened and solidified in a tube or a waste ink sump while the above described recovery operation is carried out, and may hinder the recovery operation from being normally carried out. For this reason, as disclosed in Japanese Patent Application Laid-Open No. 2002-225312 for instance, a recovery unit is separately placed in each of a discharge portion (discharge port) for black ink and a discharge portion (discharge port) for color ink so that the inks are not be thickened and solidified in a cap or the recovery tube.

The ink (waste ink), which has been drained by the above described recovery treatment is introduced into an ink absorbing member placed in a main body of a recording apparatus through a tube placed in a downstream side of a sucking pump, is absorbed by the ink absorbing member and is collected. On the other hand, there is a method for achieving a picture of high quality when the picture is recorded on plain paper, by promoting the coagulation of color materials in ink on the paper surface. The method also enhances coagulating properties of the ink drained during the recovery treatment, namely, a waste ink which is not used in recording. Accordingly, it is important for the ink absorbing member for collecting the waste ink through the recovery treatment to efficiently absorb the ink having the rapidly coagulating properties. As for a conventional structure for storing the waste ink, for instance, Japanese Patent Application Laid-Open No. 2000-127439 discloses a waste ink tank that accommodates the ink absorbing member which has a recess extending to a position including a waste ink inlet formed therein. In addition, Japanese Patent Application Laid-Open No. 2001-105626 discloses a waste ink tank that accommodates an ink absorbing member having a through-hole through which the waste ink is drained dropwise, and having a cut channel radially formed from the through-hole.

However, a structure described in Japanese Patent Application Laid-Open No. 2002-225312 needs to separately install a capping unit in each of discharge port arrays for black ink and color ink, needs to upsize a recording head, and consequently increases a cost for manufacturing an ink jet recording apparatus. As a method for solving the problem that the recording head needs to be upsized, a method is conceived which prevents the above described thickened substance from forming by using inks of black pigment ink and color dye ink that do not react with each other. Such a method enables the pigment ink and the dye ink to be sucked and restored while preventing the mixture of both inks from being thickened, precipitating or being solidified, even when both of the inks are simultaneously and preliminarily discharged from one discharge face having the discharge port array for the pigment ink and the discharge port array for the dye ink arranged therein. However, such a method causes a technical problem that the black ink and the color ink produce bleeding (blur or color mixture) between them when an image is recorded on plain paper.

The present inventors made an extensive investigate on the improvement of ink, while aiming at the further improvement of image performance such as image density and the capability of inhibiting bleeding, and as a result, it has been elucidated that the ink which instantly lowers its dispersion stability and increases viscosity due to the evaporation of water shows higher image performance as well. The above type of ink causes viscosity increase (viscosity rise-up) not by a rapid coagulation reaction such as an electrostatic neutralizing reaction occurring between an anion and a cation, but by a reduction of a water in an ink liquid, and accordingly shows a large effect only in the latter case. Accordingly, a recording head even having a discharge port array for a pigment ink and a discharge port array for a dye ink arranged together thereon can suck a mixed ink containing a pigment and a dye without causing the thickening, precipitation or solidification of the mixed ink, even by using a common sucking unit, and can restore itself. In other words, the mixed ink does not lower its dispersion stability so long as the mixed ink is not dried due to the evaporation or diffusion of water, accordingly is kept at low viscosity and does not cause any problem in being sucked and restored. However, the ink (waste ink) which instantly decreases the dispersion stability due to the evaporation of water has lower absorbance by the ink absorbing member than the conventional ink. Accordingly, there was a case where the conventional waste-ink absorbing member could not sufficiently absorb the waste ink.

Japanese Patent Application Laid-Open Nos. 2002-225312 and 2000-127439 disclose that the ink absorbing member can inhibit waste ink from evaporating in the vicinity of a waste ink introduction part and can avoid the waste ink from losing flowability by forming a recess or a cut channel in the ink absorbing member, which extends from a position including the waste ink introduction part. However, when the ink has properties of instantly decreasing dispersion stability due to the evaporation of water, a pigment in the ink is solidified and fixed at a position at which the ink is drained dropwise into a waste ink tank. In other words, when the waste ink contacts a waste-ink absorbing member before the waste ink decreases flowability, a pigment in the waste ink precipitates and is fixed at the contact position. As a result of this, there was a case where the waste ink drained dropwise at the position deposited on a fixed matter as a core and finally blocked the flow of the ink to the recess or the cut channel. As a result of this, there was a case where the waste ink overflowed from the vicinity of the waste-ink introduction site before the whole recess or cut channel was used to the maximum, and the whole waste-ink absorbing member could not be effectively used.

SUMMARY OF THE INVENTION

The present invention is designed with respect to such a technical problem. An object of the present invention is to provide an ink jet recording apparatus which can prevent a mixed ink collected by an ink absorbing member from thickening or being solidified, even when such inks which react with each other are sucked through the same cap in a sucking recovery operation for a recording head. Another object of the present invention is to provide an ink jet recording apparatus which can keep an adequate absorptivity of the ink absorbing member for a long period of time.

The present invention relates to an ink jet recording apparatus for recording an image by discharging ink from a recording head onto a recording medium on the basis of image information. The ink jet recording apparatus according to the present invention has: a recovery unit for draining ink from a black-ink discharge portion for discharging black ink and a color-ink discharge portion for discharging color ink which reacts with the black ink; an ink absorbing member for collecting the ink which is drained by the recovery unit and separating the ink into a solid part and a liquid part; and an ink introduction unit for introducing the ink which is drained by the recovery unit, into the ink absorbing member.

An ink jet recording apparatus according to the present invention can vaporize, on an ink absorbing member, water of a mixed ink of a pigment ink drained from a black-ink discharge portion and a dye ink which has been drained from a color-ink discharge portion and has reactivity with the pigment ink. As a result of this, the ink jet recording apparatus can separate the drained ink into a solid part of a pigment and a liquid part of a dye, and retain the solid part and the liquid part on the ink absorbing member. Accordingly, the ink jet recording apparatus can keep an adequate absorptivity of the ink absorbing member for a long period of time, even when recording an image of high quality free from blur by reacting black ink with color ink to make them solidified or thickened when recording the image.

Further features of the present invention will become apparent from the following description of Examples with reference to the attached drawings.

BRIEF DESCRIPTION OF THE DRAWINGS

FIG. 4A illustrates a state of a cap separated from a discharge face of a recording head, and FIG. 4B illustrates the state of the cap which closely contacts the discharge face of the recording head.

DESCRIPTION OF THE EMBODIMENTS

Figure 1:
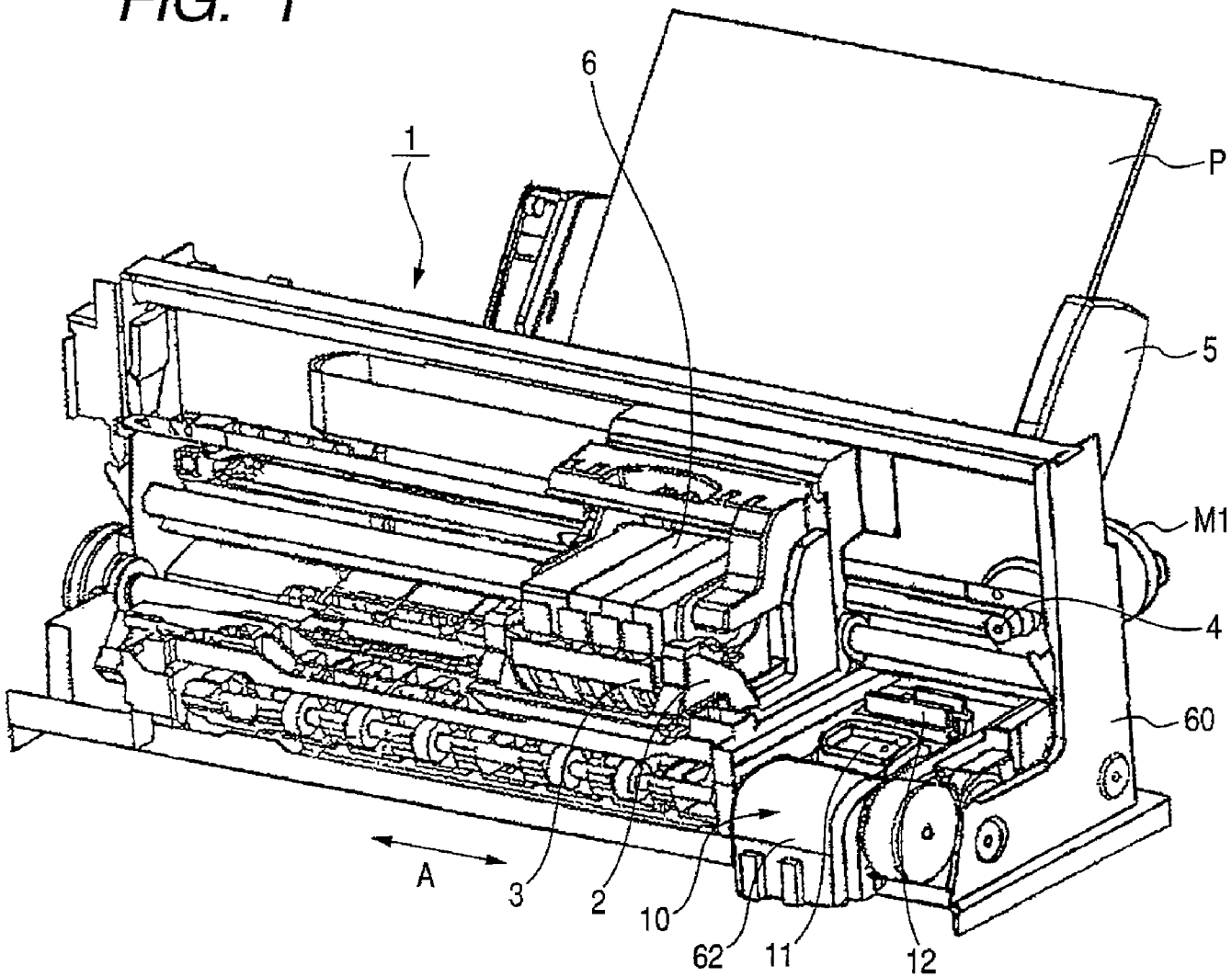
FIG. 1 is a perspective view illustrating a diagrammatic structure of an ink jet recording apparatus to which the present invention can be applied.

In the next place, embodiments according to the present invention will be described specifically with reference to the drawings. The same symbol in each drawing denotes the same part or corresponding part. FIG. 1 is a perspective view showing a diagrammatic structure of an ink jet recording apparatus to which the present invention can be applied. In FIG. 1, the ink jet recording apparatus 1 has: a carriage 2 which moves while mounting a recording head 3 thereon; and a carriage motor M1 and a transmission mechanism 4 for reciprocating the carriage 2 in both directions shown by an arrow A. The ink jet recording apparatus 1 also has: a paper feed mechanism 5 for feeding a recording medium such as recording paper; and a recovery device 10 for recovering the discharge of the recording head 3. These components of the ink jet recording apparatus 1 are attached to a chassis 60 of the main body of the apparatus.

An ink tank (ink cartridge) 6 is detachably mounted in a recording head 3 carried by a carriage 2. Ink in the ink cartridge 6 is supplied to the recording head 3. A platen (not illustrated) for supporting a recording medium is installed at a position opposite to a discharge face (face having discharge ports arranged therein) of the recording head 3 carried by the carriage 2. A recording medium (P) fed from the paper feeding mechanism 5 is transported through a recording section (on the platen) by a transportation roller 61 driven by a transportation motor (not illustrated). The recording head 3 is a component for recording an image on the recording medium by discharging ink on the basis of an image signal. The ink jet recording apparatus 1 records an image on the recording medium transported over the platen by giving a driving signal based on the image signal to the recording head 3, in synchronization with the movement of the carriage 2 which is driven by the motor M1. The recording medium (P) having an image recorded is ejected from the main body of an apparatus by an ejection roller 63.

Figure 2:
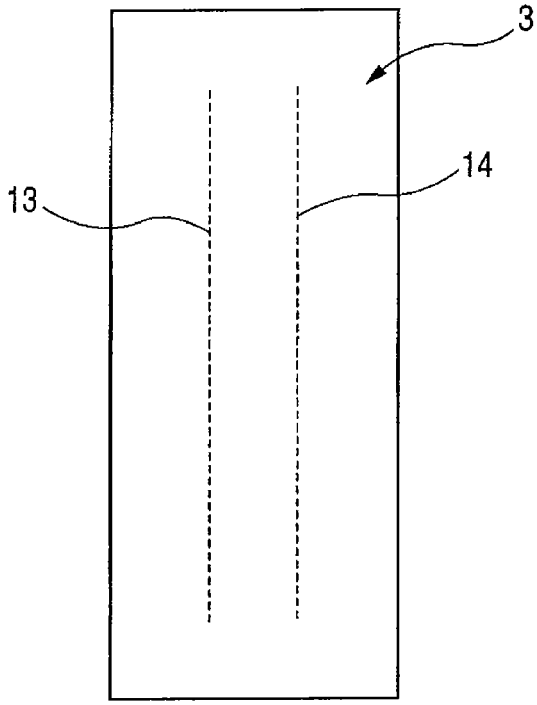
FIG. 2 is a schematic block diagram illustrating an arrangement example of a discharge port array formed on a discharge face of a recording head in FIG. 1.
Figure 3:
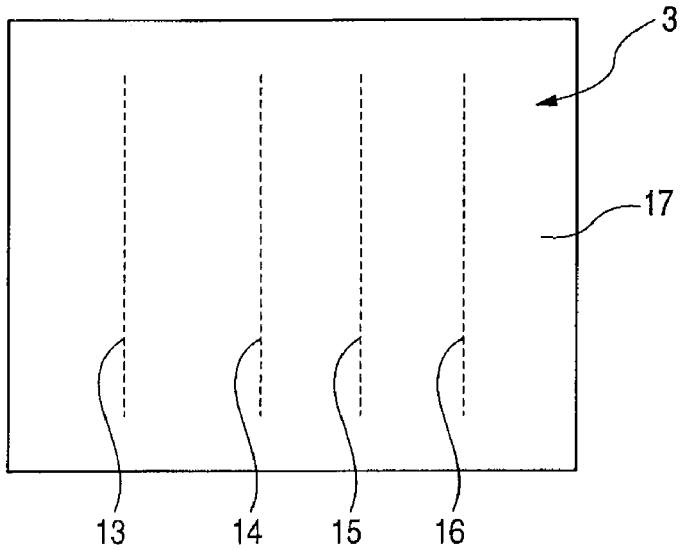
FIG. 3 is a schematic block diagram illustrating another arrangement example of a discharge port array formed on a discharge face of a recording head in FIG. 1.

A recording head 3 in FIG. 1 is the one for color recording, and a carriage 2 (or the recording head 3) mounts four ink cartridges 6 thereon which accommodate inks of each color of magenta (M), cyan (C), yellow (Y) and black (K). These four ink cartridges can be each independently attached and detached. FIG. 2 is a schematic block diagram illustrating an arrangement example of a discharge port array formed on a discharge face of a recording head in FIG. 1. FIG. 3 is a schematic block diagram illustrating another arrangement example of a discharge port array formed on a discharge face of a recording head in FIG. 1. A recording head 3 illustrated in FIG. 2 has two discharge port arrays of a discharge port array 13 for black ink and a discharge port array 14 for yellow ink (color ink), formed on one discharge face 17. On the other hand, a recording head 3 in FIG. 3 has four discharge port arrays of a discharge port array 13 for black ink, a discharge port array 14 for yellow ink (color ink), a discharge port array 15 for magenta ink and a discharge port array 16 for cyan ink, formed on one discharge face 17. In other words, FIGS. 2 and 3 illustrate a discharge face which has the discharge port array for the black ink and the discharge port array for the color ink arranged together.

A recording head 3 records an image by selectively discharging ink from a plurality of discharge ports when pulse voltage corresponding to a recording signal (image signal) is applied thereon. The recording head 3 according to the present embodiment in particular is provided with an electrothermal transducing member which generates thermal energy for discharging the ink when the pulse voltage is applied thereon. The recording head 3 discharges an ink droplet from the discharge port by making the electrothermal transducing member generate the thermal energy, making a film boil to grow and shrink a bubble and using the consequent pressure change. The electrothermal transducing member is individually provided in each of a plurality of the discharge ports, and makes the discharge port corresponding to the electrothermal transducing member discharge the ink droplet, by applying pulse voltage to the electrothermal transducing member in response to a recording signal.

Figure 4A:
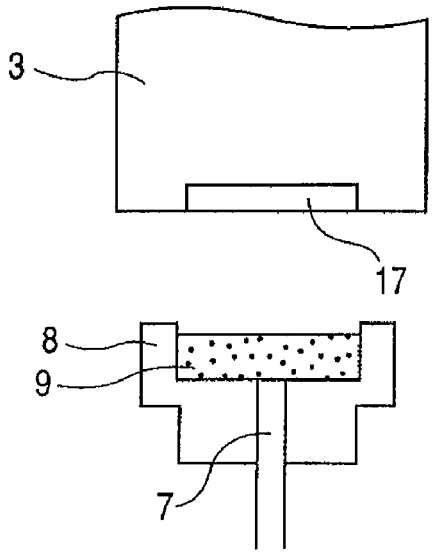
FIGS. 4A and 4B are longitudinal sectional views of a capping unit in FIG. 1.
Figure 4B:
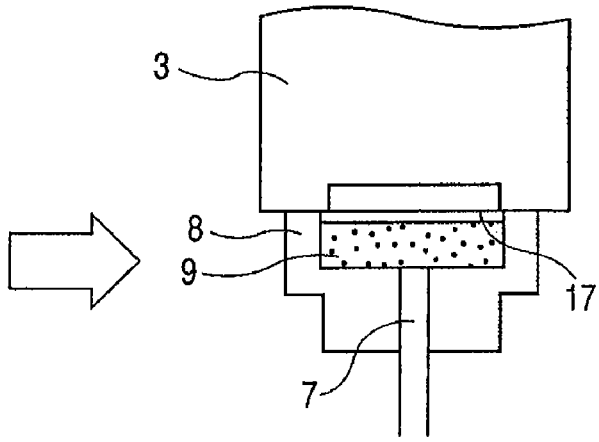

In FIG. 1, a recovery device 10 for maintaining and recovering the ink-discharging performance of a recording head 3 is installed at a predetermined position (for instance, at a home position of a carriage) in a movable range of the carriage 2 and out of a recording region. The recovery device 10 is provided with a capping unit 11 for covering a discharge port of the recording head 3, and a wiping unit 12 for wiping and cleaning the discharge face of the recording head 3. The recovery device 10 is also provided with a sucking unit 62 consisting of a sucking pump which is connected to a cap 8 (FIGS. 4A and 4B) in the capping unit 11, and the like. FIGS. 4A and 4B are longitudinal sectional views of a capping unit 11 in FIG. 1. FIG. 4A illustrates a state of a cap 8 separated from a discharge face 17 of a recording head 3, and FIG. 4B illustrates the state of the cap which closely contacts the discharge face of the recording head.

In FIGS. 1, 4A and 4B, a cap 8 for covering a discharge port by closely contacting a discharge face 17 of the recording head 3 is filled with an ink absorbing member 9 for absorbing and retaining ink. The ink absorbing member 9 is made from a porous material or a sponge material. A cap 8 is connected to a sucking tube 7. Another end side of the sucking tube is connected to a waste-ink-collecting portion including an ink absorbing member 31 described below through a sucking pump 62. The sucking pump 62 according to the present embodiment is a tube pump. Accordingly, the ink jet recording apparatus can operate the sucking pump 62 in a state of capping the discharge face 17 with a cap 8 to generate a negative pressure in the cap 8, thereby suck ink from each discharge port, and forcefully drain the ink. Thereby, the ink jet recording apparatus can drain and remove a clogging factor such as thickened ink and a bubble existing in an ink flow path of the recording head 3. In other words, suck-recovery is made to the recording head 3 by making the sucking pump 62 suck ink through the sucking tube 7.

The sucking recovery operation shall keep and recover the ink discharge performance of a recording head by eliminating the clogging in a discharge port through refreshing ink in each of the discharge ports (in each nozzle).

Then, the ink (waste ink) drained from a discharge port by the sucking operation is sent to a waste-ink-collecting portion connected to a sucking pump 62. The waste-ink-collecting portion is constituted by an ink absorbing member. The recording head is occasionally recovered by a preliminarily discharging operation for discharging the ink which does not contribute to recording toward an ink sump (or a cap 8) from each discharge port not illustrated.

The ink (waste ink) discharged to the ink sump through the preliminarily discharging operation is also sucked by the sucking pump 62 and is sent to the above described waste-ink-collecting portion. Thus, it is possible to protect a recording head 3 and also prevent ink from evaporating and drying while the recording head 3 is not in operation, by capping a discharge port of the recording head 3 with a cap 8. In addition, ink or dirt depositing on a discharge face 17 of the recording head 3 can be wiped and removed by a wiping mechanism 12. A capping unit 11, a wiping unit 12 and a sucking unit 62 as described above can co-operatively and appropriately keep and recover the ink discharge performance of the recording head 3 into a normal state.

Figure 5:
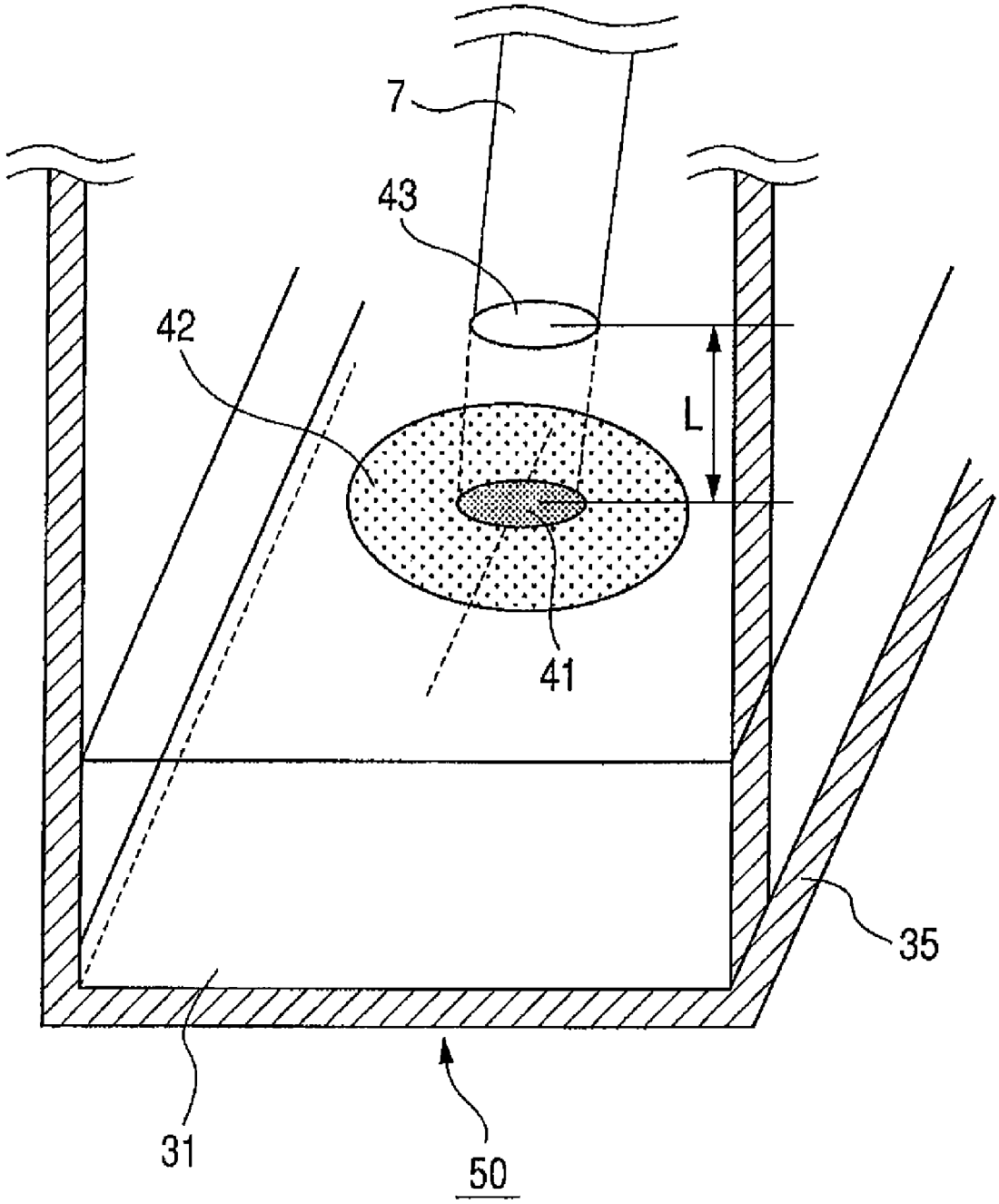
FIG. 5 is a sectional perspective view of a part of a waste-ink-collecting unit in an ink jet recording apparatus according to a first embodiment in the present invention.

FIG. 5 is a partial perspective view illustrating the structure of a waste-ink-collecting unit in an ink jet recording apparatus according to a first embodiment in the present invention. An ink jet recording apparatus according to the present invention is the one for recording an image on a recording medium by discharging ink to the recording medium from a recording head on the basis of image information. The ink jet recording apparatus according to a first embodiment has a recovery unit for draining ink from a black-ink discharge portion 13 for discharging black ink and a color-ink discharge portion 14 (or, 14, 15 and 16) for discharging a color ink which reacts with the black ink. The above described recovery unit is constituted by a cap 8 and a sucking pump 62, as shown in FIGS. 1, 4A and 4B.

The recovery unit keeps discharge characteristic normal or recovers the discharge characteristics to a normal condition, by forcefully draining ink from a recording head 3, apart from a discharge operation for recording.

An ink jet recording apparatus according to a first embodiment also has an ink absorbing member 31 (FIG. 5) for collecting ink drained by a recovery unit and separating the ink into a solid part and a liquid part; and further has an ink introduction unit 7 (FIGS. 4A, 4B and 5) for introducing the ink drained by the recovery unit into an ink absorbing member. The ink absorbing member 31 collects and retains the ink (waste ink) drained by sucking recovery treatment and the like for a recording head 3. The ink introduction unit 7 introduces the ink (waste ink) drained by the recovery unit into the above described ink absorbing member and makes the ink absorbing member introduce the ink into itself; and is constituted by a sucking tube 7 as shown in FIGS. 4A and 4B.

At a predetermined position of the main body of a recording apparatus, a waste-ink-collecting unit 50 is arranged so as to collect ink drained by a sucking recovery unit 62, as is shown in FIG. 5. The waste-ink-collecting unit 50 is constituted by a container-shaped frame 35 and an ink absorbing member 31 accommodated thereby. The ink absorbing member 31 has only to be a material (member) provided with a function for moderately retaining the ink (waste ink), and is not limited in particular. A usable material includes, for instance, the one constituted by a porous member such as a sponge and a fibrous body using a pulp as a material; a polymeric absorbent; or a member made of a paper-shaped body having the polymeric absorbent sprinkled thereon. Reference numeral 43 in FIG. 5 denotes an outlet of a sucking tube 7. Reference numerals 41 and 42 in FIG. 5 denote a solid part and a liquid part formed by separating the ink with the ink absorbing member 31, which will be described later in detail.

In the next place, examples of the ink and a coloring material will be described which can be used in an ink jet recording apparatus according to the present invention. An object of the present invention is to prevent a mixed ink from thickening or being fixed, even when such inks as to react with each other are sucked through the same cap in a sucking recovery operation for a recording head. The present invention provides an ink capable of further improving bleeding performance. The above described object is more effectively achieved by using the ink of which the coloring material precipitates when having contacted an ink absorbing member (also referred to as waste-ink absorbing member) for collecting the waste ink.

As a result of having searched for a cause or a factor which causes the above phenomenon, it was found that the ink has characteristic properties and shows a phenomenon associated with the characteristics of a coloring material itself, a relationship between the coloring material and a solvent and a mixed state of them, which will be described below. However, the present invention is not limited to the following description, but can be applied to various coloring materials in ink and the inks which cause newly found properties and phenomena or characteristic properties and phenomena.

Incidentally, bleeding means the blur or color mixture of ink formed on a recording medium. In addition, bleeding performance means the performance of reducing or inhibiting the bleeding.

The ink having improved bleeding performance is an ink, for instance, using a self-dispersion pigment (such as carbon black) as a coloring material, which is coupled with a functional group having hydrophilicity directly or through another atomic group. Furthermore, the ink is also an ink (first ink) with the use of a plurality of water-soluble organic solvents at least one of which is a poor solvent having characteristics of lowering the dispersion stability of the pigment. When such ink is applied on a recording medium, the poor solvent increases its ratio with respect to the pigment along with the evaporation of water, so that the pigments start coagulating with each other in the upper layer of the recording medium. As a result of this, the ink can show a function (or performance) of inhibiting bleeding, even singly or even when another ink exists in the periphery.

Furthermore, as for a coloring material in first ink, when the ink uses a pigment densely having hydrophilic groups coupled on the pigment surface as the coloring material, the ink remarkably shows the following phenomenon.

Specifically, the ink remarkably shows the phenomenon that the coloring material is solidified and adhered to a waste-ink absorbing member and the waste-ink absorbing member extremely lowers the absorptivity thereof along with showing the above described advantage remarkably. In this case, a pigment is hardly solvated by a solvent in ink in comparison with a conventional self-dispersion pigment, because of being affected by steric hindrance originating in a coloring material structure, and the ink shows a tendency of lowering the dispersion stability of the pigment due to the evaporation of a trace amount of water. As a result of this, the ink has an effect of further reducing bleeding.

Furthermore, bleeding can be further reduced by an ink which is thickened or increases its particle size along with the evaporation of water, specifically, which varies an average particle diameter by about 25% or more between before and after the evaporation of water, when about 40% of water have evaporated from a liquid.

The particle size can be easily confirmed without diluting the ink, by using, for instance, Fiber-Optics Particle Analyzer with Autosampler FPAR-1000 (trade name; made by Otsuka Electronics Co., Ltd.)

The inks have an effect of further reducing bleeding, which show higher viscosity when the viscosity of the mixture is measured after a pigment black ink has been mixed with a dye color ink, than both of the viscosities of the pigment black ink and the dye color ink.

Examples of such a dye color ink are a dye color ink containing a solvent which is a poor solvent with respect to a pigment contained in the pigment black ink; and further an ink having a coloring material with a structure having a benzene ring in an end at least as the coloring material. The coloring material with the structure having the benzene ring in the end has generally characteristics of easily being adsorbed by the pigment. When such a dye color ink is mixed with pigment ink, the dye color ink deteriorates the dispersion stability of the pigment. In the present application, such a dye ink is referred to as a dye color ink which causes a phase reaction with the pigment black ink.

In addition, when a first ink and a second ink show higher viscosity when the viscosity of the mixture is measured after the two inks have been mixed than both of the viscosities of the first ink and the second ink, the first ink and the second ink have an effect of further reducing bleeding.

An evaporation degree of water from waste ink varies according to, for instance, a material of a waste-ink tube, an inner diameter of the tube, or the quantity of the ink (waste ink) drained by one recovery operation.

However, the quality of a material for a generally-used waste-ink tube and the inner diameter of the tube are limited, and the quantity of the waste ink drained by one recovery operation is also generally in a predetermined range.

Incidentally, a poor solvent according to the present invention is a solvent which shows such characteristics as "a particle in a pigment-dispersed liquid which includes about 50 mass % of a solvent to be evaluated and disperses a coloring material to be used in ink therein shows a larger size than the particle in a pigment-dispersed liquid described below, after the former liquid has been kept at 60° C. for 48 hours". This "a pigment-dispersed liquid described below" is "a pigment-dispersed liquid which includes no or a small amount of the solvent to be evaluated and disperses the water-insoluble coloring material to be used in the ink therein". In addition, a good solvent is a solvent which shows the characteristics except those of the poor solvent.

prescribe a position for the waste ink originating in each ink to be introduced, as the above description. Specifically, the above relationship between the first ink and the second ink includes a relationship that when both of the inks are mixed and the viscosity of the mixture is measured, the viscosity is higher than any one of the viscosities of the respective inks.

A specific example of a second coloring material includes the coloring material shown in a structural formula (1) and a structural formula (2), which facilitates the waste ink originating in a first ink and a second ink to form a barrier for inhibiting the waste ink from diffusing or migrating into a waste-ink absorbing member, when the waste ink contacts the waste-ink absorbing member.

Formula 1

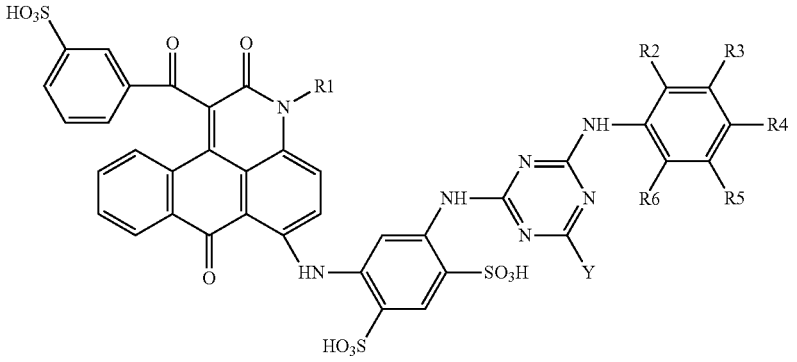

Structural Formula (1)

In the next place, an example of a second ink will be shown which inhibits a first ink and the second ink from diffusing or migrating into a waste-ink absorbing member when the first ink is made contact with the second ink.

The example includes a second ink which contains, for instance, a poor solvent with respect to a pigment contained in a first ink, for the purpose of further reducing bleeding to be formed on a recording medium. The example further includes an ink that contains coloring materials at least one of which has a structure having a benzene ring (which may have a hydrophilic moiety in a part when having a hydrophobic moiety in most parts) in an end. The coloring material with the structure having a benzene ring in the end is generally provided with characteristics of easily being adsorbed by pigment.

The second ink thus deteriorates the dispersion stability of pigment, so that the first ink and the second ink easily form a barrier which inhibits a waste ink originating in both inks from diffusing or migrating into a waste-ink absorbing member, when the waste ink contacts the waste-ink absorbing member. Accordingly, the inks make a technical problem of preventing the inks from thickening and being fixed due to mixing in the present invention remarkable, and make an effect obtained by solving the technical problem as well remarkable. Furthermore, when the first ink and the second ink have a relationship described below, it is necessary to R1 in the above described "Structural Formula (1)" represents a hydrogen atom, an alkyl group, a hydroxy lower alkyl group, a cyclohexyl group, a monoalkylamino alkyl group, a dialkylamino alkyl group or a cyano lower alkyl group. Y in "Structural Formula (1)" represents a chlorine atom, a hydroxyl group, an amino group, a monoalkylamino group or a dialkylamino group. The monoalkylamino group and the dialkylamino group may have a substituent selected from the group consisting of a sulfo group, a carboxyl group and a hydroxyl group on the alkyl group. R2, R3, R4, R5 and R6 in "Structural Formula (1)" each independently represent a hydrogen atom, an alkyl group having 1 to 8 carbon atoms or carboxyl group. However, all of R2, R3, R4, R5 and R6 cannot be simultaneously a hydrogen atom.

A specific example of a compound shown in "Structural Formula (1)" includes each exemplary compound which has a structure shown in each chemical formula in the following "Formula 2" in a form of a free acid. Among these exemplary compounds M1 to M7, the exemplary compound of M7 can be used in particular.

Formula 2
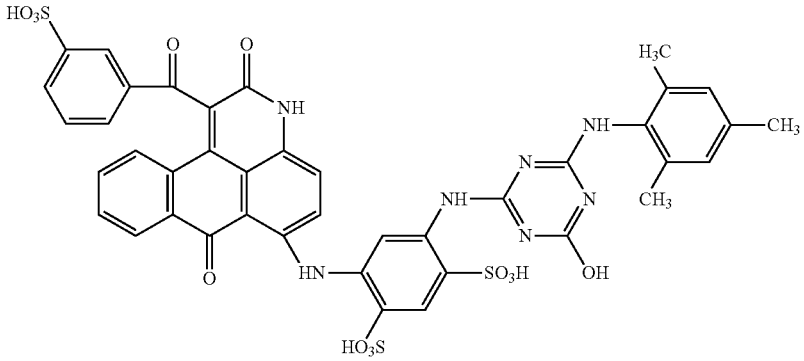
Exemplary compound M1
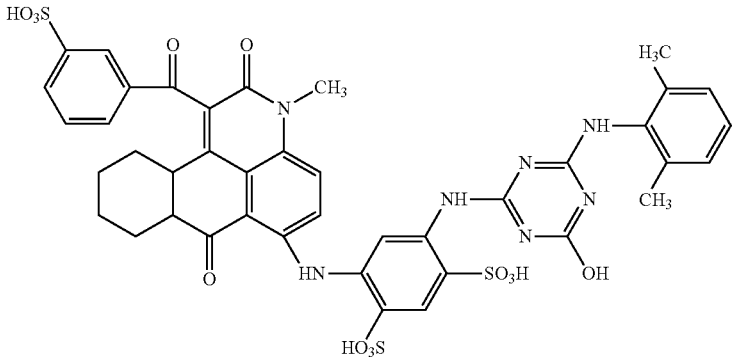
Exemplary compound M2
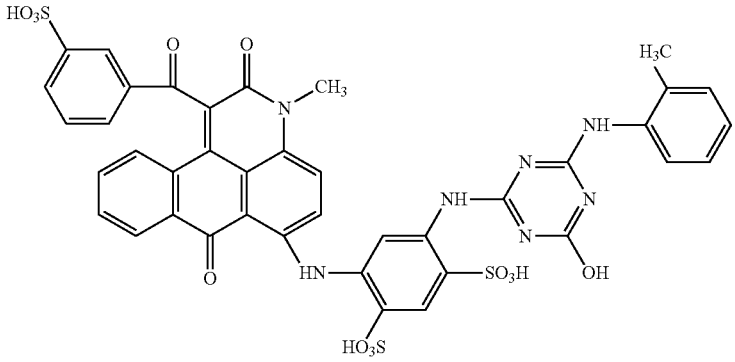
Exemplary compound M3

-continued
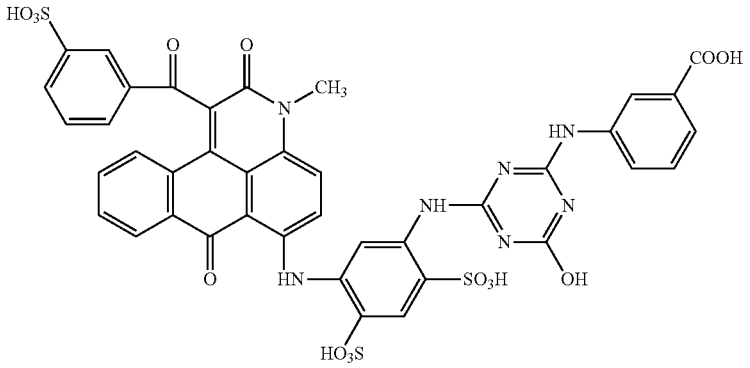
Exemplary compound M4
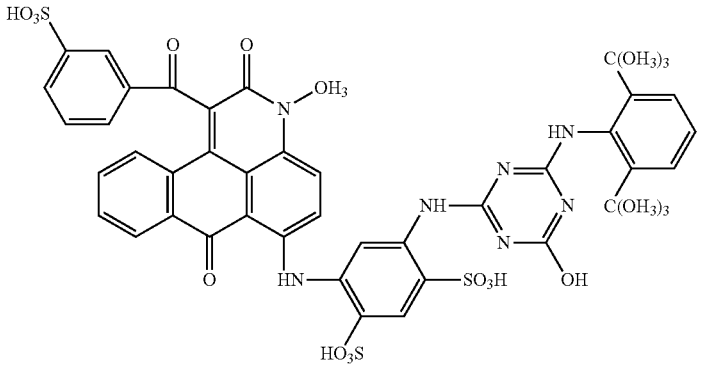
Exemplary compound M5
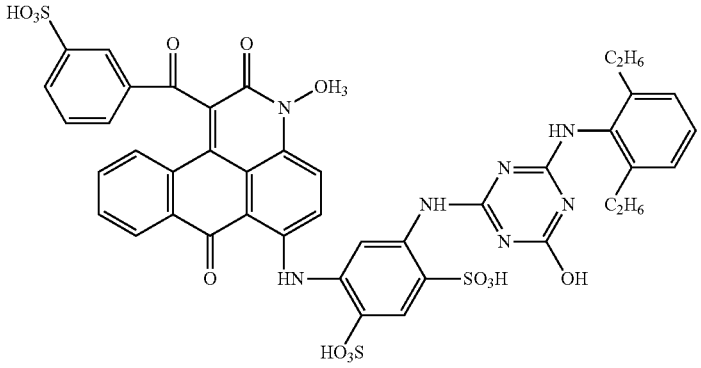
Exemplary compound M6
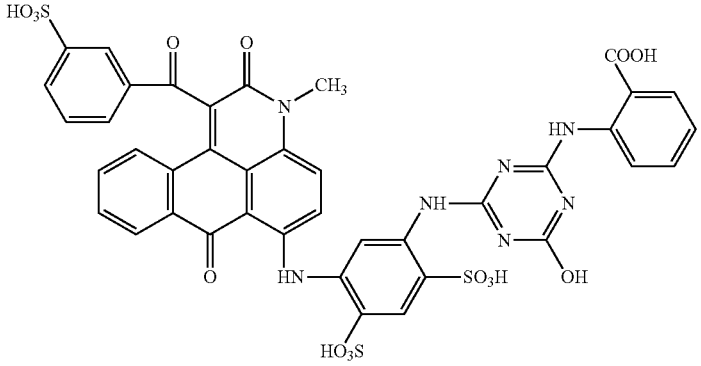
Exemplary compound M7

-continued

Formula 3

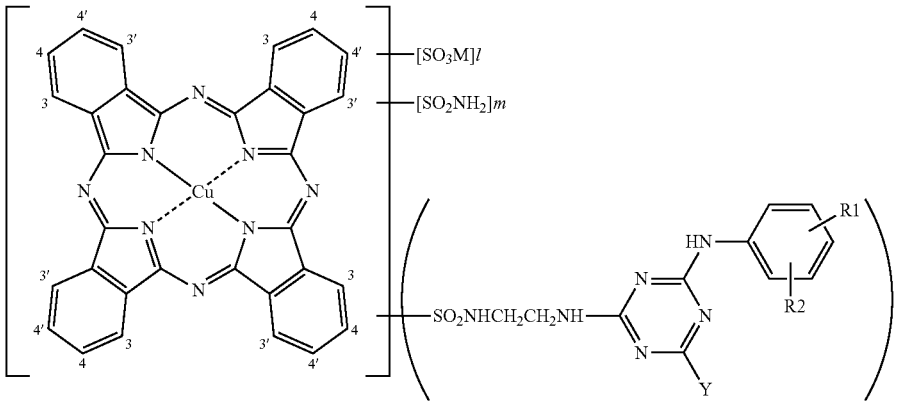

Structural Formula (2)

In the above described "Structural Formula (2)", l=0 to 2, m=1 to 3, n=1 to 3, while satisfying l+m+n=3 to 4, and a substitution site by a substituent is shown by 4 or 4'. M in "Structural Formula (2)" represents an alkali metal or ammonium. R1 and R2 represent each independently a hydrogen atom, a sulfo group or a carboxyl group. However, R1 and R2 cannot be simultaneously a hydrogen atom. Y in "Structural Formula (2)" represents a chlorine atom, a hydroxyl group, an amino group, a monoalkylamino group or a dialkylamino group.

A coloring material shown in "Structural Formula (2)" is a characteristic phthalocyanine compound that is prepared by: using a phthalocyanine compound as a raw material, which is obtained by reacting a 4-sulfophthalic derivative, or a 4-sulfophthalic derivative and a phthalic derivative (for instance, phthalic anhydride) in the presence of a metallic compound; converting a sulfone group in the raw material to a chlorosulfone group; and reacting the resultant compound with an amination agent in the presence of an organic amine.

A coloring material shown in "Structural Formula (2)" is a characteristic phthalocyanine compound which has an unsubstituted sulfamoyl group (—$SO_2NH_2$) and a substituted sulfamoyl group (Structural Formula (3) of "Formula 4" described below) introduced only at positions of 4 and 4' in the structural formula. The above positions of 4 and 4' in "Structural Formula (2)" are the positions of R2, R3, R6, R7, R10, R11, R14 and R15 in "Structure Formula (2)". It was found that the ink using such a compound as a coloring material has extremely superior resistance to an environmental gas.

Formula 4

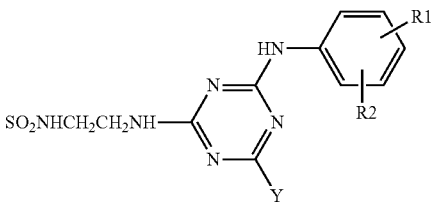

Structural Formula (3)

A specific example of a compound shown by "Structural Formula (3)" includes each exemplary compound having a structure shown by each chemical formula of "Formula 5" described below in a form of a free acid. Among these exemplary compounds C1 to C7, the exemplary compound C1 can be used in particular.

Formula 5

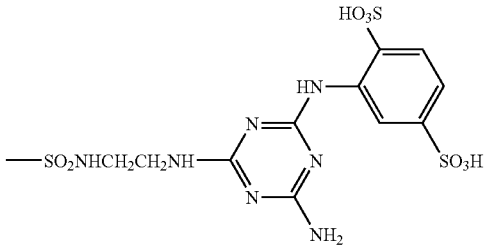

Exemplary compound C1

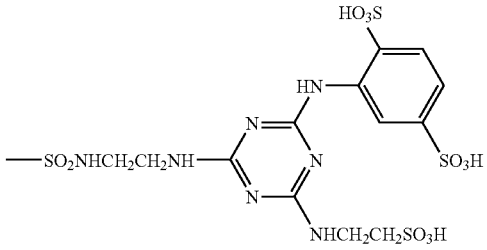

Exemplary compound C2

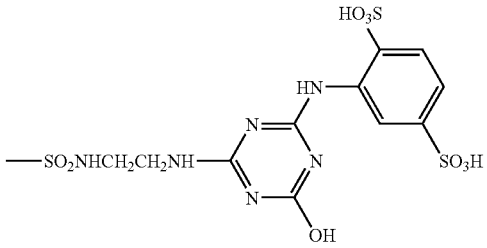

Exemplary compound C3

-continued

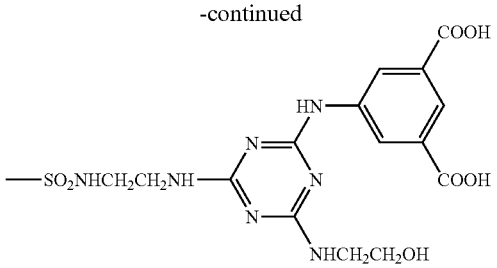

Exemplary compound C4

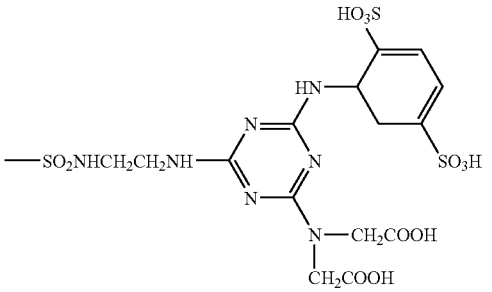

Exemplary compound C5

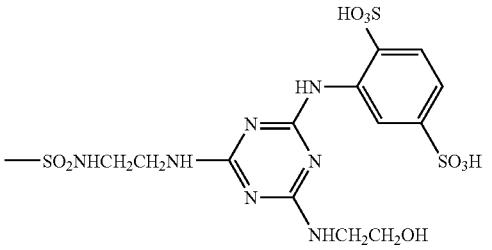

Exemplary compound C6

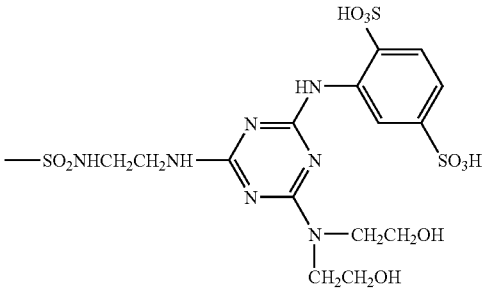

Exemplary compound C7

By using the first ink and the second ink having the above described characteristics, the ink jet recording apparatus can markedly improve bleeding performance in comparison with conventional inks. However, it was found that the above described respective waste inks cause a phenomenon of forming such a barrier as to inhibit the respective waste inks from diffusing or migrating into a waste-ink absorbing member, when the respective waste inks are each drained dropwise to an adjacent part of the waste-ink absorbing member.

In the next place, a first embodiment according to the present invention will be described in detail with reference to the drawings. FIG. 5 is a sectional perspective view of a part of a waste-ink-collecting unit 50 in an ink jet recording apparatus according to a first embodiment in the present invention.

The structure of FIG. 5 is the same structure as in the waste-ink-collecting unit according to Example 1 described below. In FIG. 5, an ink absorbing member (waste-ink absorbing member) 31 is accommodated in a container-shaped frame 35 arranged in a lower case or the like of the recording apparatus. The ink absorbing member 31 has a generally rectangular solid shape as a whole, and is accommodated in the frame 35 so that the side surface and the bottom face contact an inner wall surface of the frame 35 having the rectangular shape. A material of the ink absorbing member 31 has only to have a function of moderately retain the waste ink, and is not limited in particular. For instance, a usable material can include a porous member such as a sponge or a fibrous body using a pulp as the material. A usable ink absorbing member can also include a member made from a polymer absorbent or a member made of a paper-shaped body having the polymer absorbent sprinkled thereon. The ink (waste ink) which has been drained by a sucking pump 62 and introduced by a sucking tube 7 is drained dropwise from an outlet 43 of the sucking tube to the ink absorbing member 31. The sucking tube 7 composes an ink introduction unit for introducing the drained ink to the waste-ink-collecting unit 50. As described above, in the present embodiment, the waste ink is directly drained dropwise from the ink introduction unit 7 onto the ink absorbing member 31.

Figure 6:
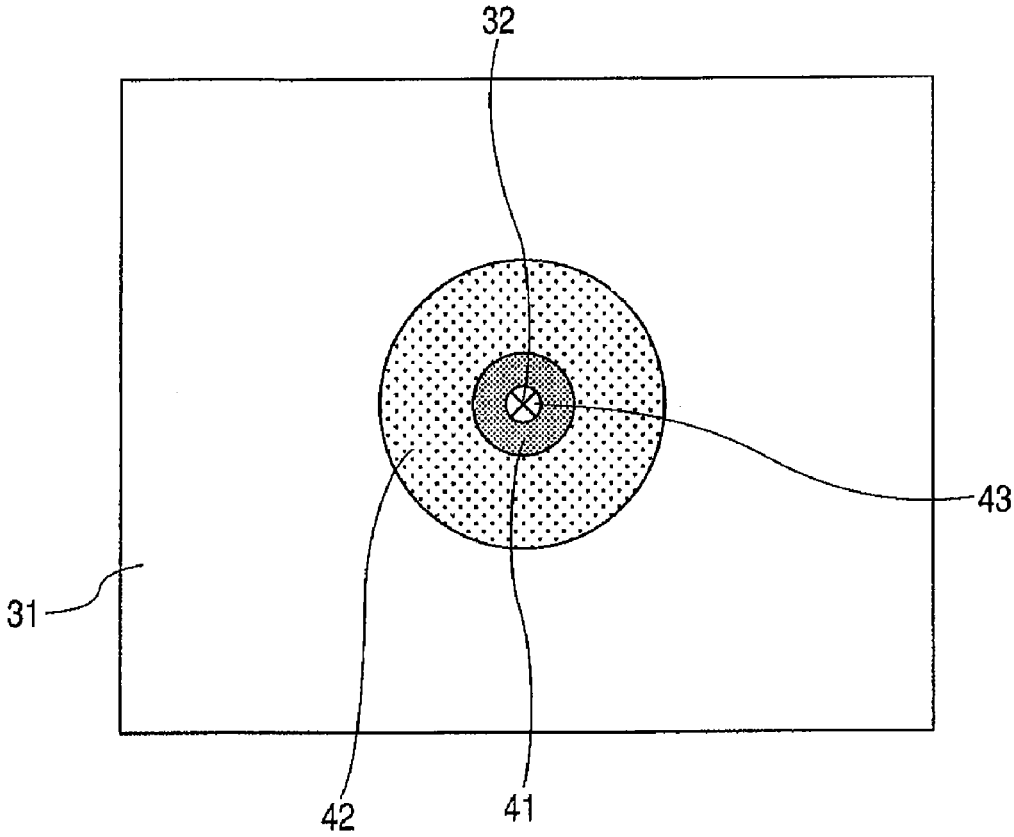
FIG. 6 is a plan view illustrating a state of an initial stage when the waste ink drained dropwise to an ink absorbing member illustrated in FIG. 5 is separated into a solid part and a liquid part.
Figure 7:
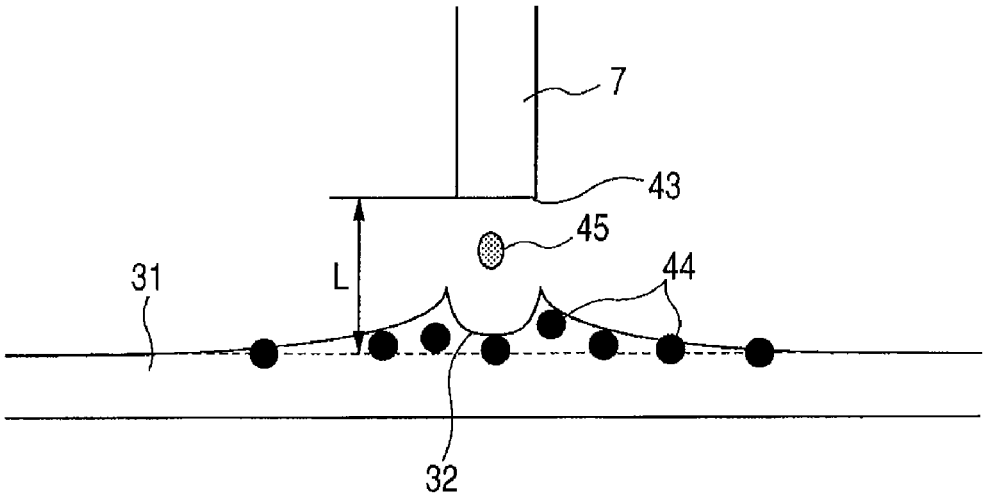
FIG. 7 is a longitudinal sectional view illustrating a state in an initial stage in FIG. 6 when a black pigment of a solid part is separated from a liquid part and deposits on an ink absorbing member.

FIG. 6 is a plan view illustrating a state of an initial stage when the waste ink drained dropwise to an ink absorbing member 31 in FIG. 5 is separated into a solid part 41 and a liquid part 42. FIG. 7 is a longitudinal sectional view illustrating a state in an initial stage in FIG. 6 when a black pigment 44 of a solid part 41 is separated from a liquid part and deposits on an ink absorbing member.

Figure 8:
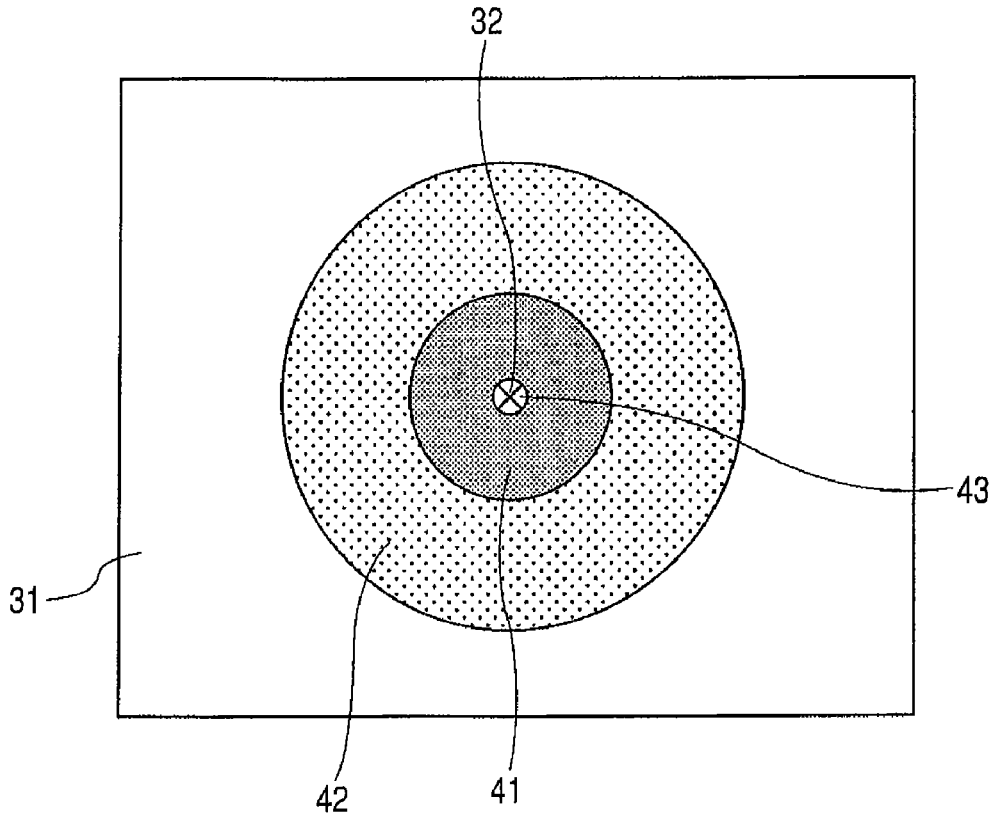
FIG. 8 is a plan view illustrating a state when separation between the solid part and the liquid part has proceeded after the state illustrated in FIG. 6, along with repeated recovery treatment.
Figure 9:
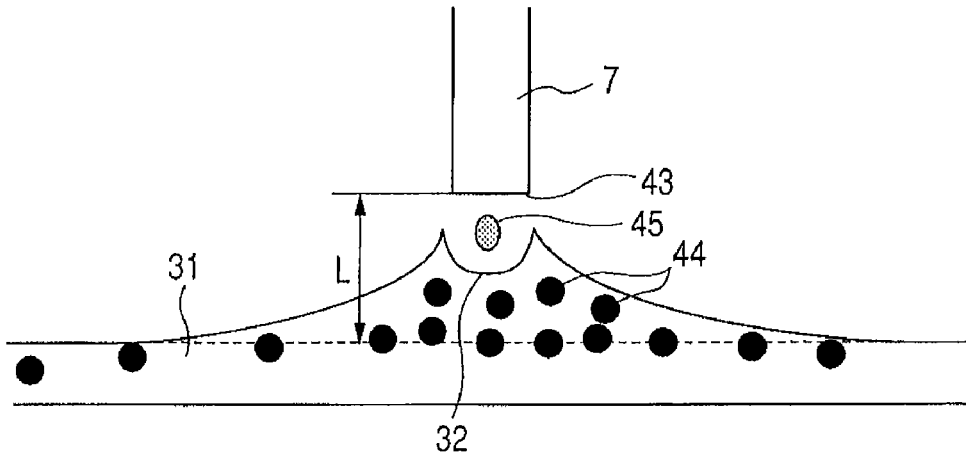
FIG. 9 is a longitudinal sectional view illustrating a state in a stage of FIG. 8 when a black pigment of a solid part is separated from a liquid part and deposits on an ink absorbing member.

FIG. 8 is a plan view illustrating a state when separation between the solid part 41 and the liquid part 42 has proceeded after the state illustrated in FIG. 6, along with repeated recovery treatment. FIG. 9 is a longitudinal sectional view illustrating a state in a stage of FIG. 8 when a black pigment 44 of a solid part 41 is separated from a liquid part and deposits on an ink absorbing member. In FIGS. 6 and 8, an oblique cross mark (x) shows a position 32 (drained part) at which a waste ink 45 is drained dropwise to an ink absorbing member 31 from an outlet 43 of a waste ink tube (ink introduction tube) 7. When the mixed ink (waste ink) 45 of the pigment ink (black ink) and the dye ink (color ink) is drained dropwise onto the ink absorbing member 31, it suddenly coagulates on the absorbing member due to the evaporation of water and increases its viscosity.

In other words, as illustrated in FIG. 6, the drained ink (waste ink) is collected by an ink absorbing member 31, and is immediately separated into a solid part 41 of a pigment and a liquid part 42 of a dye (solid-liquid separation). The higher is a density of the ink absorbing member 31, the more remarkably the drained ink shows a tendency of being separated immediately.

As waste ink is repeatedly collected by repeating a sucking recovery operation, a separated solid part 41 and liquid part 42 expands, as illustrated in FIGS. 8 and 9. FIGS. 7 and 9 illustrate the state in time series, in which a black pigment 44 of the solid part 41 deposits on an ink absorbing member 31.

The ink absorbing member 31 is separately arranged below an outlet 43 of a sucking tube 7. However, a distance (L) between the outlet 43 and the surface of the ink absorbing member 31 is not limited in particular.

However, when a distance (L) is too short, an outlet 43 in itself may be blocked by thickened waste ink. Accordingly, it is necessary to secure the distance (L) to some extent. FIG. 9 is a longitudinal sectional view after a sucking recovery operation has been further repeated. A deposit of the black pigment 44 increases its height. However, when the mixed ink (waste ink) 45 is drained dropwise onto the deposit, a part of the deposit onto which the mixed ink has been drained dropwise dissolves again, because the deposit is an agglomerate caused by the evaporation of water. This is considered to be because water in the mixed ink 45 redisperses a pigment 44 and the part onto which the mixed ink 45 has been drained dropwise becomes flowable. Accordingly, it can be said that the ink used in the present embodiment hardly causes blockage in the waste ink outlet 43.

Here, an ink to be used in an ink jet recording apparatus according to the present invention will be described in detail with reference to a specific example. However, the present invention is not limited to the example.

At first, a method for preparing a pigment-dispersed body for black ink will be described with reference to a specific example. The pigment-dispersed body for black ink was prepared by: at first, preparing a hydrochloric acid solution by dissolving 5 g of concentrated hydrochloric acid in 5.5 g of water, and adding 1.5 g of 4-amino-1,2-benzene dicarboxylic acid to the solution, while keeping the solution cooled to 5° C.; subsequently, accommodating a container containing the solution in an ice bath and stirring the solution to keep the solution to 10° C. or lower, preparing a sodium nitrite solution by dissolving 1.8 g of sodium nitrite in 9 g of water cooled to 5° C., and adding the latter solution to the former solution; further stirring the above mixed solution for 15 minutes, and adding 6 g of carbon black with a specific surface area of 220 $m^2/g$ and a DBP oil absorption of 105 mL/100 g into the solution while stirring the solution; and subsequently, further stirring the above mixed liquid for 15 minutes. Self-dispersible carbon black was prepared by: filtering obtained slurry with a filter paper (trade name: Standard Filter Paper No. 2; made by Advantec); thoroughly washing particles with water; and drying the particles in an oven of 110° C. A dispersion liquid having a concentration of 10 mass % of the pigment dispersed therein was prepared further by adding water to the obtained self-dispersible carbon black. The pigment-dispersed liquid obtained by the above described method had the self-dispersible carbon black dispersed in water, which had a $—C_6H_3—(COONa)_2$ group introduced on the particle surface of carbon black.

Next, a method for preparing a black ink 1 will be described with reference to a specific example. The black ink 1 was prepared specifically by: mixing the above described pigment-dispersed liquid (35 parts by mass) with glycerine (7.0 parts by mass), diethylene glycol (6 parts by mass) and diammonium phthalate (0.5 parts by mass); mixing the above liquid further with Acetylenol E100 (an ethylene oxide adduct of acetylenic glycol made by Kawaken Fine Chemicals Co., Ltd.) (0.2 parts by mass) and water (45.3 parts by mass); stirring the above described mixture for one hour; and afterwards, pressure-filtering the mixture with a filter (FR20 made by FUJI FILM Corporation). The black ink 1 showed a viscosity of 2.3 mPa·s at 25° C.

Next, a method for preparing a yellow ink 1 will be described with reference to a specific example. The yellow ink 1 was prepared specifically by: mixing C.I. direct yellow 132 (4 parts by mass) with glycerine (7 parts by mass), polyethylene glycol 600 (4 parts by mass) and 2-pyrrolidone (5 parts by mass); mixing the above liquid further with Acetylenol E100 (an ethylene oxide adduct of acetylene glycol made by Kawaken Fine Chemicals Co., Ltd.) (1 part by mass) and water (79 parts by mass); stirring the above described mixture for one hour; and afterwards, pressure-filtering the mixture with a filter (FR20 made by Fuji Film). The yellow ink 1 showed a viscosity of 2.0 mPa·s at 25° C.

Next, a viscosity of a mixed ink of the above described black ink 1 and the above described yellow ink 1 will be described. The above described black ink 1 and the above described yellow ink 1 were mixed at a ratio of 1:1, and the mixture was thoroughly stirred. Subsequently, the liquid mixture showed the viscosity of 3.0 mPa·s when measured at 25° C. From the measurement result on the viscosity, it was confirmed that the mixing action of two inks increases (thickens) the viscosity of the mixed ink.

An ink jet recording apparatus having a waste-ink-collecting unit 50 according to the above described first embodiment will be described with reference to some Examples. In these Examples, a recovery unit (sucking pump 62) sucks the above described black ink 1 and the above described color ink 1 together; introduces the mixed ink into a waste-ink-collecting unit 50; and drains waste ink dropwise onto an ink absorbing member 31. Thus, the waste-ink-collecting unit 50 collects the waste ink.

Example 1

A used waste-ink-collecting unit 50 employed a structure which accommodates an ink absorbing member 31 with a rectangular solid shape in a frame 35 with a rectangular shape, as is illustrated in FIGS. 5 and 6. A sucking tube 7 of an ink introduction unit was arranged so that the outlet 43 was positioned above the surface of the ink absorbing member 31 separated by a distance (L).

A recording head 3 had a discharge face 17 having a discharge port array 13 for discharging a black ink 1 and a discharge port array 14 for discharging a yellow ink 1 arrayed thereon, as is illustrated in FIG. 2. The recording head 3 produced a print (formed image) with the use of the black ink 1 and the yellow ink 1, and was subjected to a sucking recovery operation of capping the recording head 3, operating a sucking pump 62 and sucking the inks through a cap 4. The sucked waste ink was drained dropwise onto the ink absorbing member 31 through the sucking tube 7. The recovery operation was repeated and an upper part of the ink absorbing member 31 was observed. Then, the waste ink (mixed ink) 45 was separated into a solid part 41 and a liquid part 42, and was retained by the ink absorbing member.

Example 2

Figure 10:
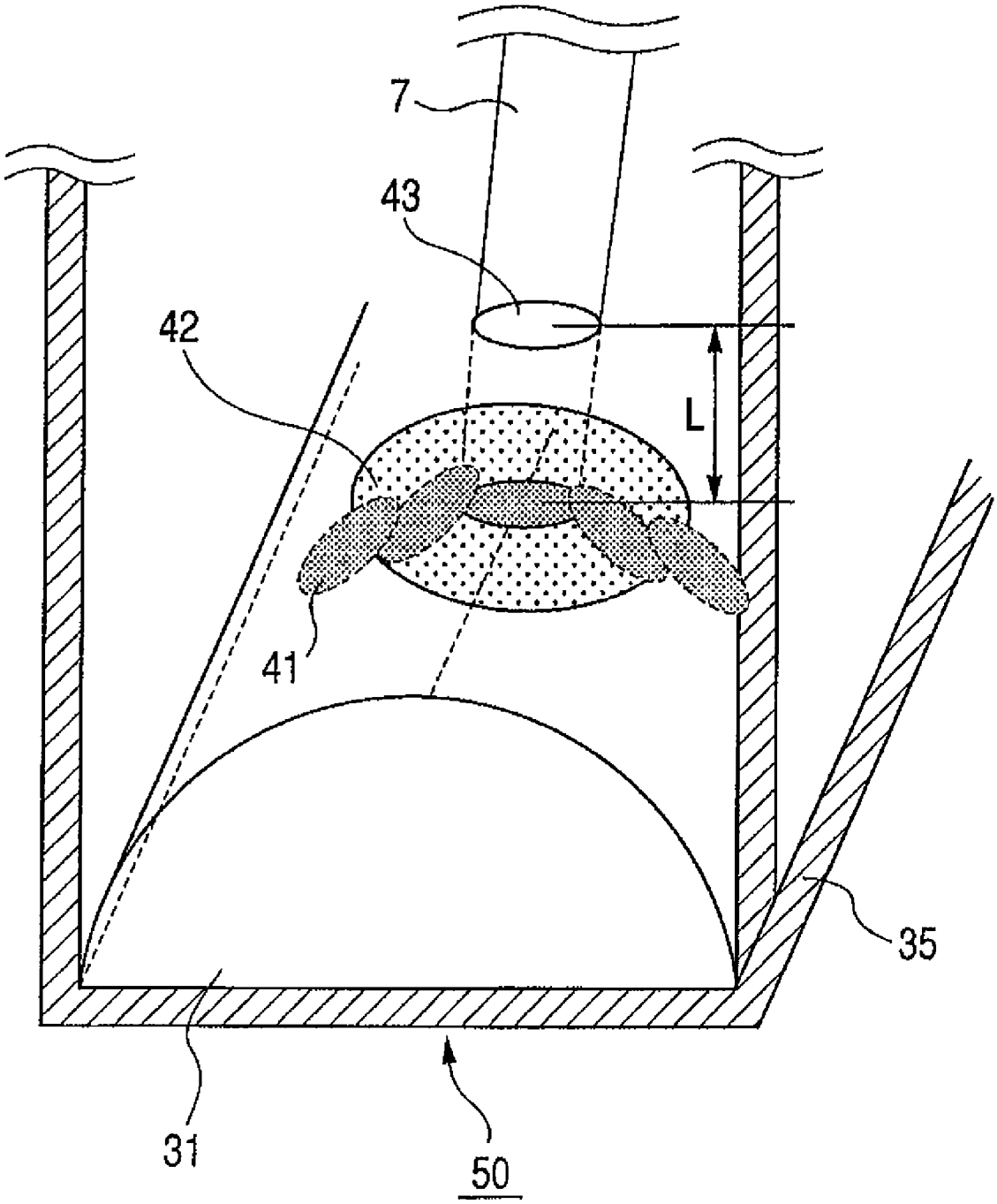
FIG. 10 is a sectional perspective view of one part illustrating a state of a waste-ink-collecting unit of an ink jet recording apparatus in Example 2 of a first embodiment according to the present invention.

FIG. 10 is a sectional perspective view of one part illustrating a structure of Example 2 of a waste-ink-collecting unit 50 in an ink jet recording apparatus according to a first embodiment. A waste-ink-collecting unit 50 used in the present Example employed a structure which accommodates an ink absorbing member 31 having a semi-columnar shape with an arc-shaped cross section in a frame 35 with a rectangular shape as is illustrated in FIG. 10, in place of a structure illustrated in FIG. 5. A sucking tube 7 was arranged so that the outlet 43 was positioned above the surface of the ink absorbing member 31 separated by a distance (L). A recording head 3 had a discharge face 17 having a discharge port array 13 for discharging a black ink and a discharge port array 14 for discharging a yellow ink arrayed thereon, as is illustrated in FIG. 2. The recording head 3 produced a print (formed image) with the use of the black ink and the yellow ink, and was subjected to a sucking recovery operation of capping the recording head 3, operating a sucking pump 62 and sucking the inks through a cap 4. The sucked waste ink was drained dropwise onto the ink absorbing member 31 through the sucking tube 7. The recovery operation was repeated and an upper part of the ink absorbing member 31 was observed. Then, the waste ink (mixed ink) 45 was separated into a solid part 41 and a liquid part 42, and was retained by the ink absorbing member, in a state as illustrated in FIG. 10. In addition, in the present Example, a deposit of the solid part 41 moved toward a lower part of the ink absorbing member 31 which has a curved surface shape outspreading downward, in comparison with Example 1. In addition, the deposit 41 was dispersed to right and left.

Example 3

Figure 11:
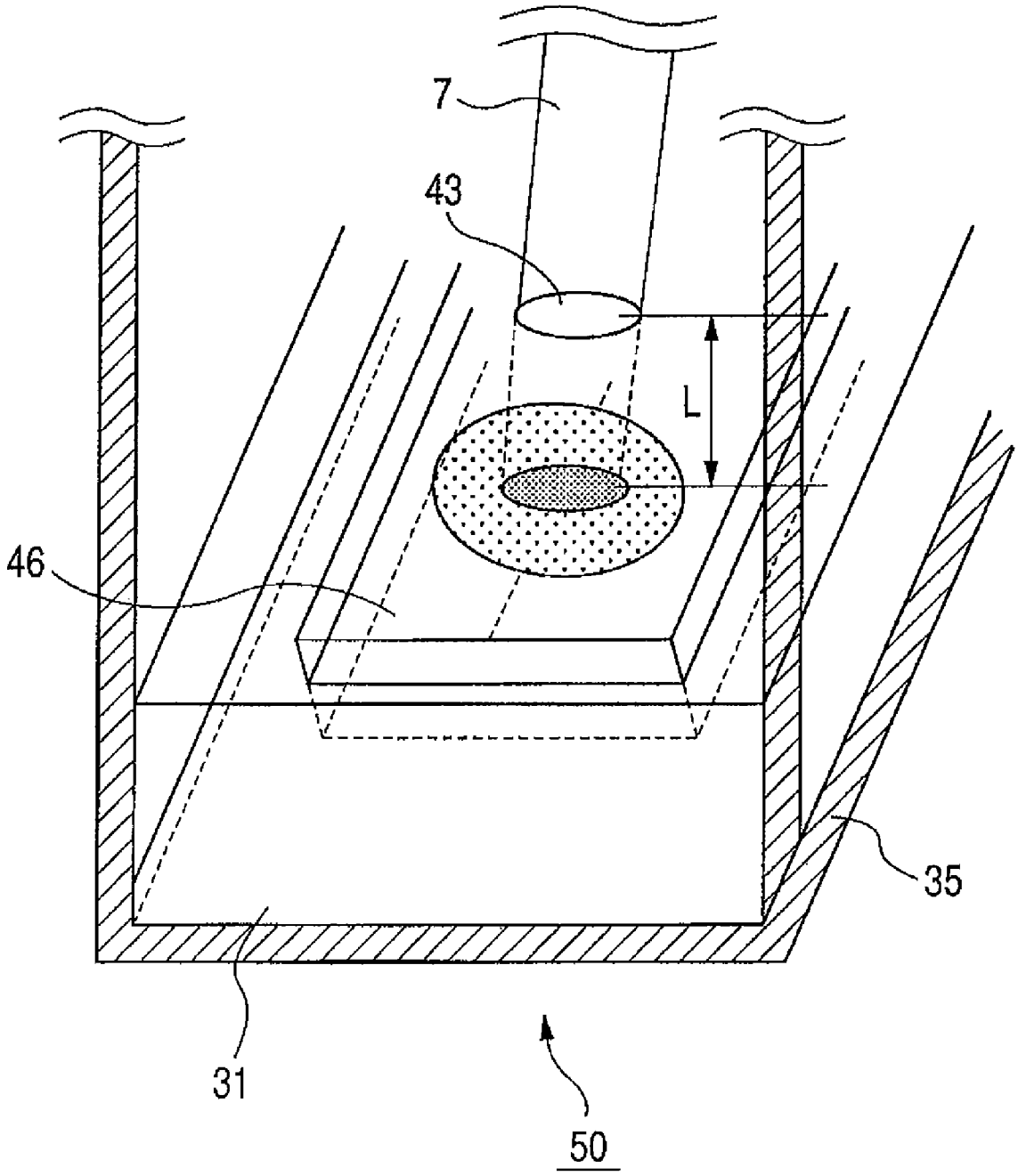
FIG. 11 is a sectional perspective view of one part illustrating a state of a waste-ink-collecting unit of an ink jet recording apparatus in Example 3 of a first embodiment according to the present invention.

FIG. 11 is a sectional perspective view of one part illustrating a structure of Example 3 of a waste-ink-collecting unit in an ink jet recording apparatus according to a first embodiment. A waste-ink-collecting unit 50 used in the present Example employed a structure as illustrated in FIG. 11, in place of a structure illustrated in FIG. 5. This waste-ink-collecting unit has a structure which accommodates an ink absorbing member 31 with a rectangular solid shape having a recess 46 formed in the upper face, in a frame 35 with a rectangular shape. The recess 46 is formed in a part onto which a waste ink 45 is drained dropwise through a sucking tube 7. In other words, in the present Example, a part of the ink absorbing member 31 below an outlet 43 is lower than the other part. The other structure is substantially the same as in the case of the above described Example 1. Then, a recovery operation was repeated which is an operation of draining the waste ink 45 drained by a recovery unit dropwise onto the recess 46. Subsequently, an upper part of the ink absorbing member 31 was observed. Then, the waste ink (mixed ink) 45 was separated into a solid part 41 and a liquid part 42, and was retained by the ink absorbing member, in a state as illustrated in FIG. 11. A deposit of the solid part 41 in the present embodiment moved towards the lower part of the sump portion (recessed part) of the recess 46 of the ink absorbing member 31, in comparison with Example 1.

Example 4

Figure 12A:
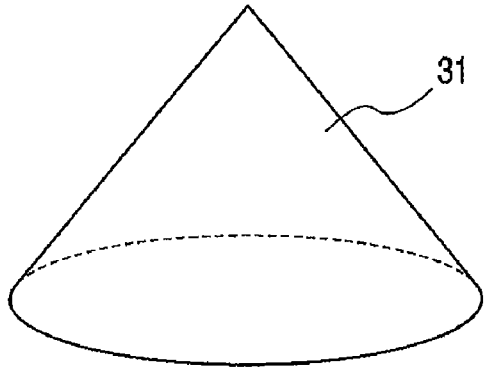
FIGS. 12A, 12B and 12C are perspective views illustrating some shapes of an ink absorbing member of a waste-ink-collecting unit in an ink jet recording apparatus in Example 4 of a first embodiment according to the present invention.
Figure 12B:
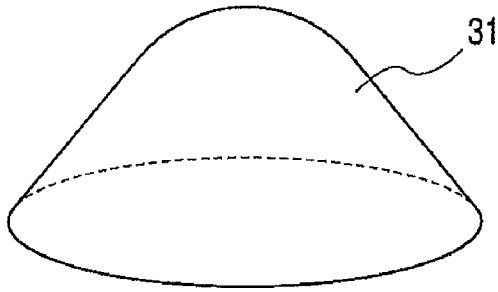
Figure 12C:
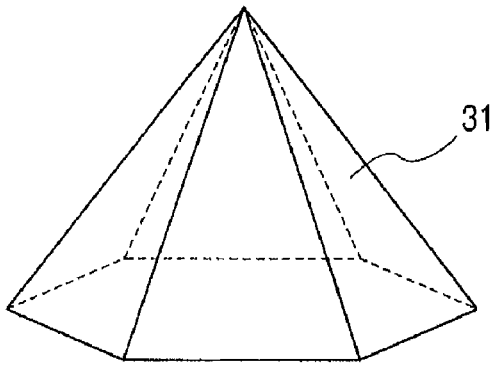

FIGS. 12A, 12B and 12C are perspective views illustrating a plurality of shapes of an ink absorbing member in Example 4 of a waste-ink-collecting unit in an ink jet recording apparatus according to a first embodiment. The present inventors used a waste-ink-collecting unit 50 which accommodates an ink absorbing member 31 having an individual shape as illustrated in FIGS. 12A, 12B and 12C in a frame 35, in place of a structure illustrated in FIG. 5. FIG. 12A illustrates the case of a cone, FIG. 12B illustrates the case of a cone having the top made to a curved surface, and FIG. 12C illustrates the case of a polyangular pyramid. All of these ink absorbing members 31 have a slope shape outspreading toward a lower side. In all the cases, a sucking tube 7 was arranged so that the outlet 43 was positioned above the vertex region of the ink absorbing member 31.

The other structure is substantially the same as in the case of the above described Example 1. Then, a recovery operation was repeated and an upper part of the ink absorbing member 31 was observed. Then, the waste ink 45 was separated into a solid part 41 and a liquid part 42, and was retained by the ink absorbing member 31. A deposit of the solid part 41 in the present embodiment was dispersed toward the lower part of the ink absorbing member 31, similarly to the case of Example 2.

In addition, in Examples 1 to 4 described above, a capability of inhibiting bleeding on a recording image was evaluated which is specifically a capability of reducing bleeding or color mixture on an image recorded by printing a black line on the backdrop of a solid printing of yellow, with the use of a black ink 1 and a yellow ink 1. As a result of this, any Example showed an extremely satisfactory capability.

An ink jet recording apparatus according to the above described embodiment drains a mixed ink of pigment ink drained from a discharge portion of black ink and a dye ink which has been drained from a color ink discharge portion and has reactivity with the pigment ink; collects it on an ink absorbing member 31; and vaporizes water in the mixed ink on the ink absorbing member.

As a result of this, the ink jet recording apparatus can separate the drained ink into a solid part 41 of pigment and a liquid part 42 of dye, and retain the solid part and the liquid part on the ink absorbing member. Accordingly, the ink jet recording apparatus can keep an adequate absorptivity of the ink absorbing member 31 of a waste-ink-collecting unit 50 for a long period of time, even when recording an image of high quality free from blur by reacting black ink with color ink to make them solidified or thickened when recording the image.

Figure 13:
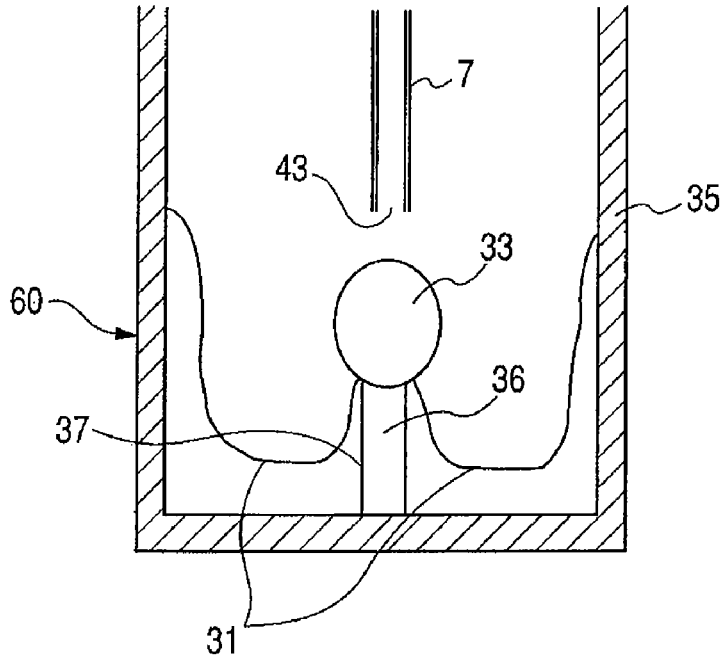
FIG. 13 is a sectional view of a waste-ink-collecting unit according to a second embodiment of an ink jet recording apparatus in the present invention.
Figure 14:
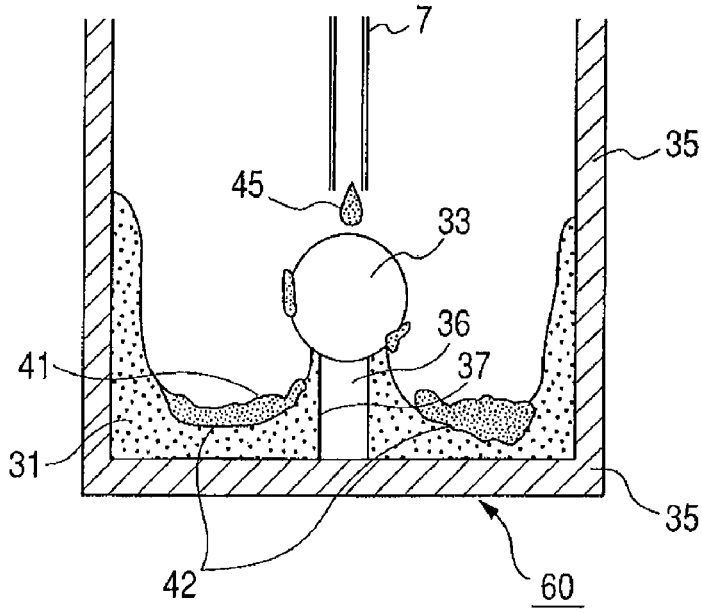
FIG. 14 is a sectional view illustrating a state of a waste ink which has been drained dropwise and is retained by an ink absorbing member in a unit for collecting the waste ink illustrated in FIG. 13.

In the next place, a second embodiment according to the present invention will be described in detail with reference to the drawings. FIG. 13 is a sectional view illustrating a structure of Example 5 of a waste-ink-collecting unit 60 in an ink jet recording apparatus according to a second embodiment. FIG. 14 is a sectional view illustrating a state of a wasted ink which has been drained dropwise and is retained by an ink absorbing member in a waste-ink-collecting unit illustrated in FIG. 13. In FIGS. 13 and 14, an ink absorbing member (waste-ink absorbing member) 31 is accommodated in a container-shaped frame 35 arranged in a lower case or the like of a recording apparatus. The frame 35 has a container shape of an approximately rectangular shape as a whole and a transfer member 33 is arranged in the center thereof. The transfer member 33 is placed in an upper end of a bar-type protruding portion 36 installed on a bottom surface of the frame 35. The ink absorbing member 31 is accommodated in the frame 35 so that the side surface and the bottom face contact an inner wall surface of the frame 35 having the rectangular shape. In the center of the ink absorbing member 31, a hole 37 is formed which engages with the protruding portion 36. In the case of the figure, the transfer member 33 and the frame 35 are made from the same material (for instance, the same plastic). Specifically, the transfer member 33 and the protruding portion 36 in FIGS. 13 and 14 are made from the same member as the frame 35.

Around the hole 37 engaging with the protruding portion 36, the ink absorbing member 31 shows such a shape as to swell up to a part right under the transfer member 33 along the protruding portion, and also shows such a shape as to swell up along an inner wall surface of a frame 35 in a peripheral area along the inner wall surface. In the case of the figure, the ink absorbing member 31 in the peripheral area swells up to a slightly higher position than the transfer member 33. Accordingly, as a whole, the ink absorbing member shows such a shape as to swell up in the central part around the protruding portion 36 and in the peripheral area, and to be dent between them while the upper surface is opened. A sucking tube 7 works as an ink introduction unit for introducing ink (waste ink) drained by a recovery unit such as a sucking pump 62 to a waste-ink-collecting unit 60.

A transfer member 33 is arranged below and detached from an outlet 43 of the sucking tube 7 which is the ink introduction unit. The ink which has been introduced by the sucking tube 7 is drained dropwise onto the transfer member 33 through the outlet 43 of the tube. In the lower part of the transfer member 33, an ink absorbing member 31 is arranged. The waste ink 45 drained dropwise onto the transfer member 33 flows down on the surface of the transfer member and is drained dropwise onto the ink absorbing member 31.

A material of an ink absorbing member 31 has only to have a function for moderately retaining waste ink, and is not limited in particular. A usable material includes, for instance, a porous member such as a sponge, or a fibrous body using a pulp as a raw material; and a member made from a polymer absorbent, or a member made of a paper-shaped body having the polymer absorbent sprinkled thereon. In the case of the figure, a transfer member 33 and a protruding portion 36 are formed integrally with a frame 35 and from the same material, but are not limited to this; and may have a structure, for instance, in which members made from different materials is jointed.

Figure 15:
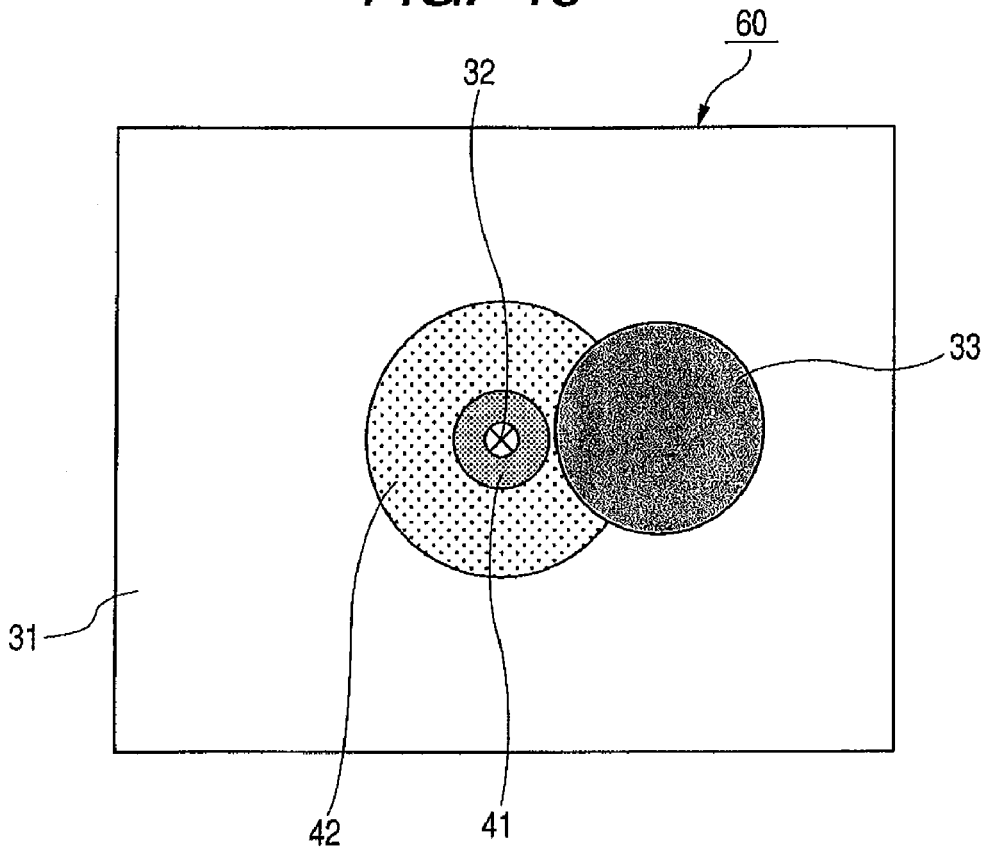
FIG. 15 is a plan view illustrating a state of an initial stage when a waste ink which has been drained dropwise to an ink absorbing member through a transfer member in FIG. 14 is separated into a solid part and a liquid part.
Figure 16:
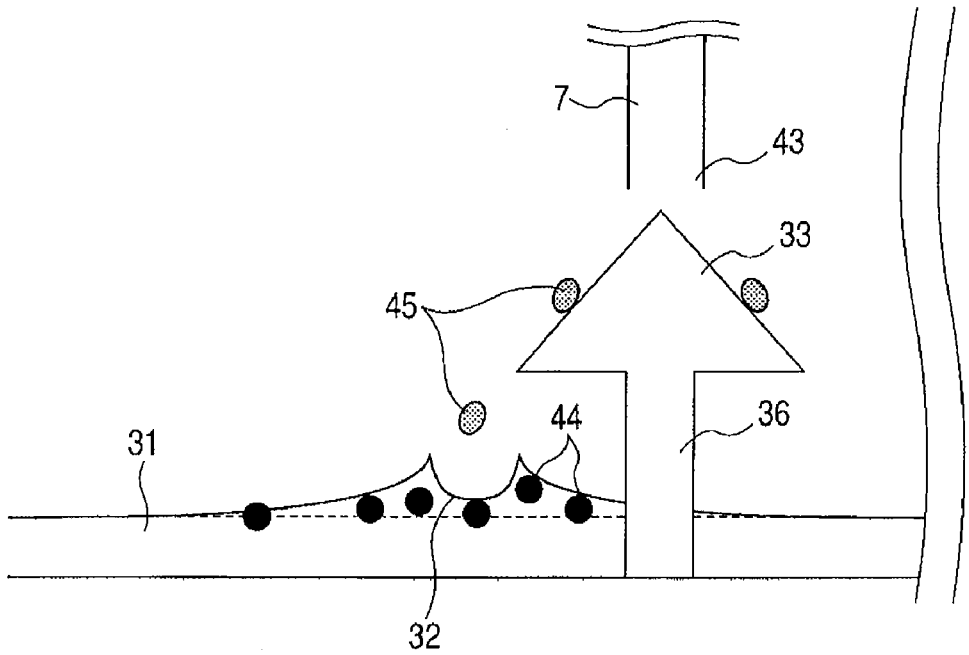
FIG. 16 is a longitudinal sectional view illustrating a state of an initial stage when a black pigment of a solid part of an ink absorbing member is separated from a liquid part and deposits on the ink absorbing member.
Figure 17:
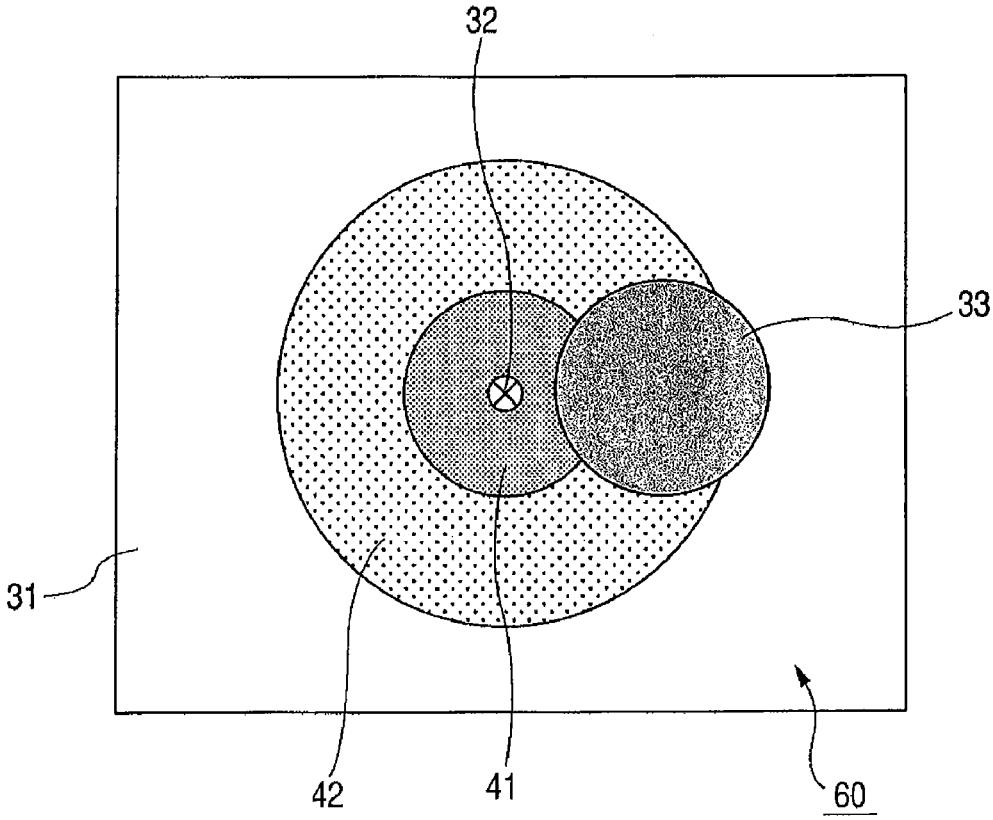
FIG. 17 is a plan view illustrating a state when separation between the solid part and the liquid part of a waste ink has proceeded after the state illustrated in FIG. 15, along with repeated recovery treatment.
Figure 18:
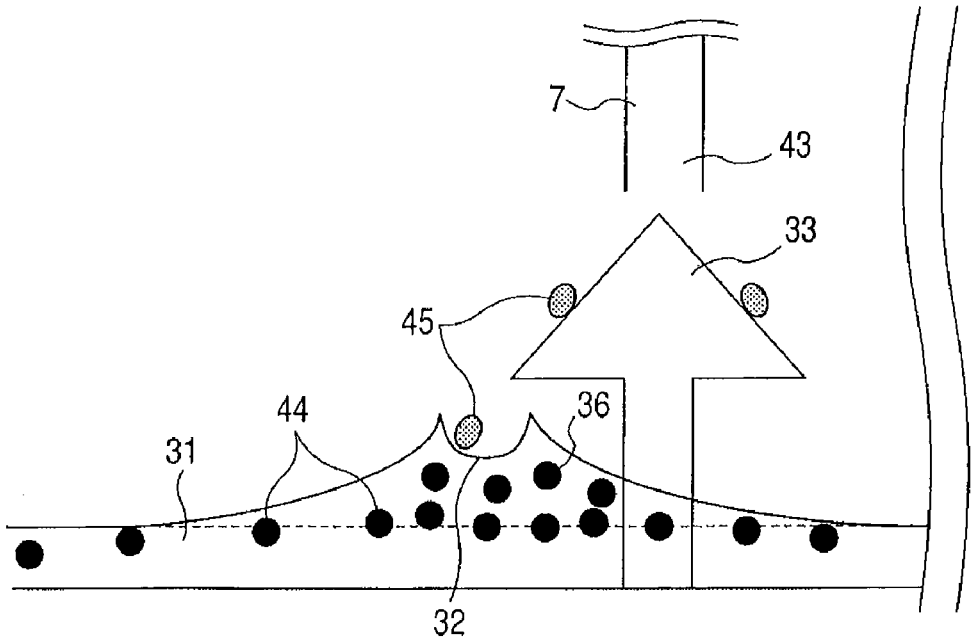
FIG. 18 is a longitudinal sectional view illustrating a state in a stage of FIG. 17 when a black pigment of a solid part is separated from a liquid part and deposits on an ink absorbing member.

FIG. 15 is a plan view illustrating a state of an initial stage when a waste ink which has been drained dropwise to an ink absorbing member 31 through a transfer member 33 in FIG. 14 is separated into a solid part 41 and a liquid part 42. FIG. 16 is a longitudinal sectional view illustrating a state of an initial stage when a black pigment of a solid part of an ink absorbing member is separated from a liquid part and deposits on the ink absorbing member. FIG. 17 is a plan view illustrating a state when separation between the solid part 41 and the liquid part 42 has proceeded after the state illustrated in FIG. 15, along with repeated recovery treatment. FIG. 18 is a longitudinal sectional view illustrating a state in a stage of FIG. 17 when a black pigment 44 of a solid part 41 is separated from a liquid part and deposits on an ink absorbing member. Reference numeral 32 in FIGS. 15, 16, 17 and 18 denotes a position of waste ink drained dropwise onto the ink absorbing member 31 through a transfer member 33. In FIGS. 13 and 14, the illustrated transfer member 33 is spherical. However, the shape of the transfer member is not limited to this but can be various shapes.

FIGS. 19A, 19B, 19C, 19D and 19E are perspective views illustrating a plurality of usable shapes of a transfer member 33.

Figure 19A:
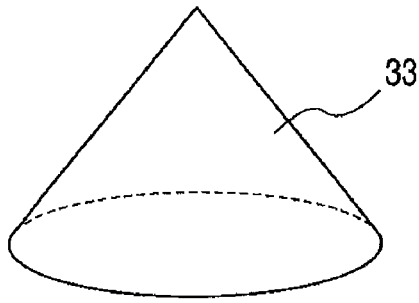
FIGS. 19A, 19B, 19C, 19D and 19E are perspective views illustrating a plurality of shapes of a transfer member 33.
Figure 19B:
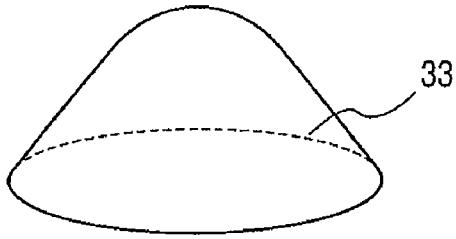
Figure 19C:
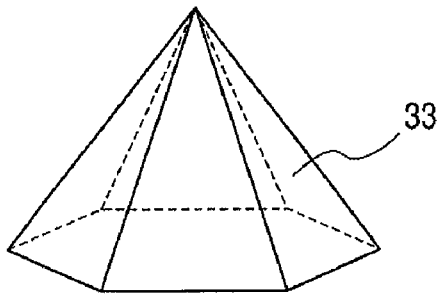
Figure 19D:
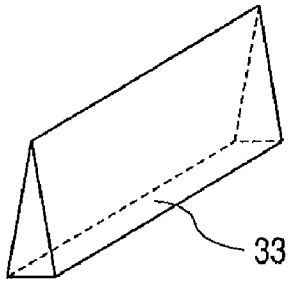
Figure 19E:
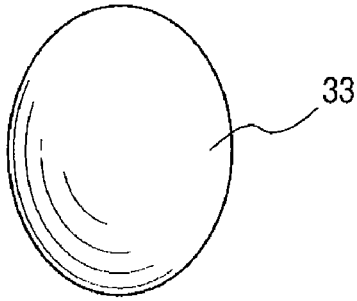

In FIGS. 19A, 19B, 19C, 19D and 19E, FIG. 19A illustrates the case of a cone having a pointed top; FIG. 19B illustrates the case of the cone having the top made to a gently curved surface; FIG. 19C illustrates the case of a polyangular pyramid; FIG. 19D illustrates the case of a triangular sectional body having an edge line on an upper edge and slopes on both sides; and FIG. 19E illustrates the case of a sphere or an ellipse sphere. The transfer member 33 in FIGS. 19A, 19B and 19C has an upwardly convexed shape. The transfer member 33 in FIG. 19D has a slope shape of which the cross section is triangular and both surfaces outspread toward a lower part. In FIGS. 13, 14, 15, 16, 17, 18, 19A, 19B, 19C, 19D and 19E, waste ink produced by recovery treatment is introduced by an ink introduction unit 7 and is drained dropwise onto an ink absorbing member 31 through the transfer member 33. FIGS. 15, 16 and 17 are schematic block diagrams illustrating a state of the waste ink 45 retained in the ink absorbing member 31, from the upper surface in time series. The waste ink having flowed on the slope of the transfer member 33 is drained dropwise onto the ink absorbing member 31 in the part illustrated by an oblique cross mark in the drawing. FIGS. 16 and 18 are schematic block diagrams illustrating a directly horizontally observed state of the waste ink of which the solid part is separated from a liquid part in the ink absorbing member 31, in time series when recovery treatment is repeated.

In FIGS. 14, 15, 16, 17 and 18, when a mixed ink (waste ink) 45 consisting of pigment ink (black ink) and dye ink (color ink) is drained dropwise onto an ink absorbing member 31, it suddenly coagulates on the ink absorbing member due to the evaporation of water and increases its viscosity. Specifically, as illustrated in FIGS. 15 and 16, the waste ink is immediately separated into a solid part 41 of pigment and a liquid part 42 of dye.

The higher is a density of the ink absorbing member 31, the more remarkably the drained ink shows a tendency of being separated immediately.

As waste ink is repeatedly collected by repeating a sucking recovery operation, a separated solid part 41 and liquid part 42 expands, as shown in FIGS. 17 and 18.

FIG. 16 illustrates a state in which a black pigment 44 of a solid part 41 gradually deposits on an ink absorbing member 31.

FIG. 18 is a sectional view of the same part as in FIG. 16 after a sucking recovery operation has been further repeated. A deposit of a solid part 41 increases its height as waste ink 45 is drained dropwise. However, when the mixed ink (waste ink) 45 is drained dropwise onto the deposit again, the deposit in the vicinity of a part onto which the mixed ink has been drained dropwise dissolves again, because the deposit 41 is an agglomerate caused by the evaporation of water. This is because water in the mixed ink 45 disperses a pigment 44 and a solid part 41 again in the vicinity of the part onto which the mixed ink 45 has been drained dropwise becomes flowable.

The second embodiment in FIGS. 13, 14, 15, 16, 17, 18, 19A, 19B, 19C, 19D and 19E has substantially the same structure as the first embodiment in FIGS. 1, 2, 3, 4A, 4B, 5, 6, 7, 8, 9, 10, 11, 12A, 12B and 12C, except the above described point. In the next place, an ink jet recording apparatus having a waste-ink-collecting unit 60 according to the above described second embodiment will be described with reference to some Examples. In these Examples, the above described black ink 1 and above described color ink 1 are sucked together by the same recovery unit (sucking pump 62). The mixed ink is introduced into the waste-ink-collecting unit 60, is drained dropwise onto an ink absorbing member 31 through a transfer member 33, and is thus collected.

Example 5

A used waste-ink-collecting unit 60 had a structure which accommodates an ink absorbing member 31 in a frame 35 with a rectangular shape, as is illustrated in FIGS. 13 and 15. A sucking tube 7 of an ink introduction unit was arranged so that the outlet 43 was positioned above a transfer member 33. A recording head 3 had a discharge face 17 having a discharge port array 13 for discharging a black ink 1 and a discharge port array 14 for discharging a yellow ink 1 arrayed thereon, as is illustrated in FIG. 2. The recording head 3 produced a print (formed image) with the use of the black ink 1 and the yellow ink 1, and was subjected to a sucking recovery operation of capping the recording head 3, operating a sucking pump 62 and sucking the inks through a cap 4. The sucked waste ink was drained dropwise onto the ink absorbing member 31 through the transfer member 33 from the sucking tube 7. The surface of the transfer member 33 can be treated to be water repellent. Such a recovery operation was repeated and the ink absorbing member 31 was observed. Then, the waste ink (mixed ink) 45 was separated into a solid part 41 and a liquid part 42, and was retained by the ink absorbing member (FIG. 14).

Example 6

Figure 20:
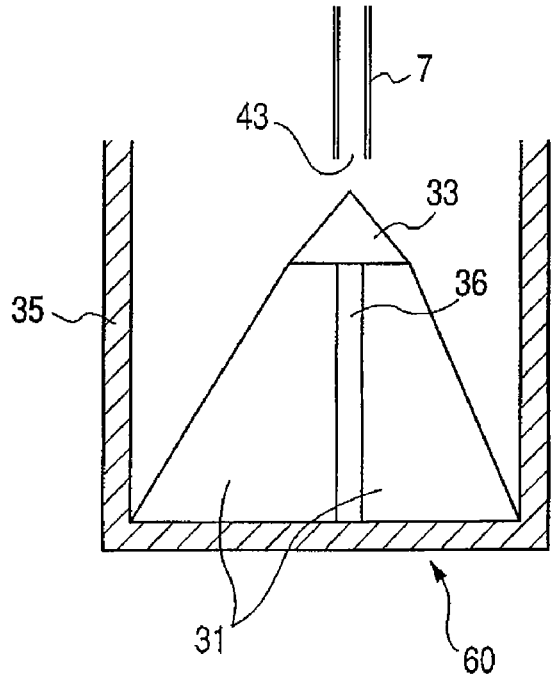
FIG. 20 is a longitudinal sectional view illustrating a state before waste ink is drained dropwise in Example 6 of a waste-ink-collecting unit in an ink jet recording apparatus according to a second embodiment in the present invention.

FIG. 20 is a longitudinal sectional view illustrating a state before waste ink is drained dropwise in Example 6 of a waste-ink-collecting unit 60 in an ink jet recording apparatus according to a second embodiment in the present invention.

Figure 21:
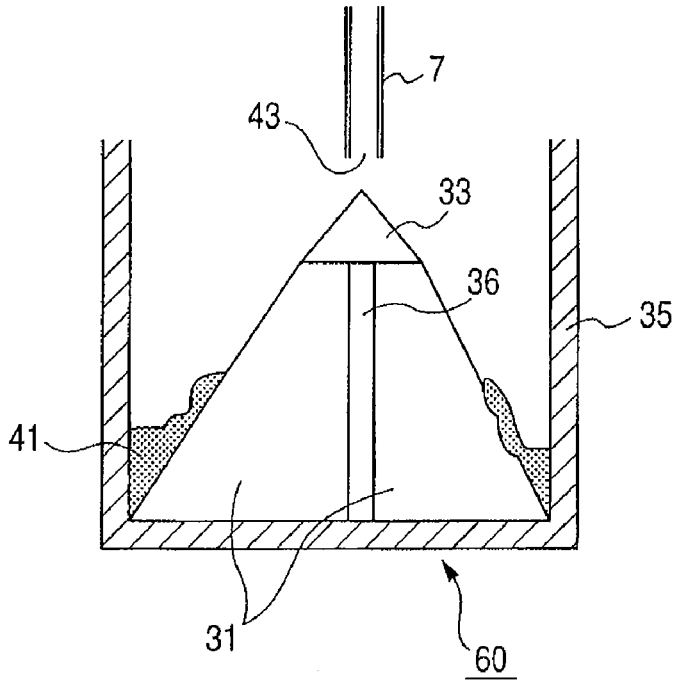
FIG. 21 is a longitudinal sectional view illustrating a state after waste ink has been drained dropwise, in a waste-ink-collecting unit illustrated in FIG. 20.

FIG. 21 is a longitudinal sectional view illustrating a state after waste ink has been drained dropwise, in a waste-ink-collecting unit 60 illustrated in FIG. 20. In the present Example, as is illustrated in FIG. 21, the waste-ink-collecting unit 60 had a bar-type protruding portion 36 installed upright in the central part of the inside of a frame 35 with a rectangular shape and a transfer member 33 with a conical shape placed on the upper end of the bar-type protruding portion 36, in place of a structure illustrated in FIG. 13. Around the protruding portion 36, an ink absorbing member 31 was arranged which had a conical shape having a slope outspreading toward a lower part from the bottom surface of a transfer member 33 to the bottom surface of a frame 35. In an Example illustrated in the figure, the ink absorbing member 31 also had the slope outspreading toward the lower part, and the slope formed by the surface of the transfer member 33 and the slope formed by the surface of the ink absorbing member 31 compose a continuous surface. However, both slopes may have the same angle or different angles.

In the present Example as well, a recording head 3 had a discharge face 17 having a discharge port array 13 for discharging a black ink 1 and a discharge port array 14 for discharging a yellow ink 1 arrayed thereon, as is illustrated in FIG. 2. The recording head 3 produced a print (formed image) with the use of the black ink 1 and the yellow ink 1, and was subjected to a sucking recovery operation of capping the recording head 3, operating a sucking pump 62 and sucking the inks through a cap 4.

Figure 22:
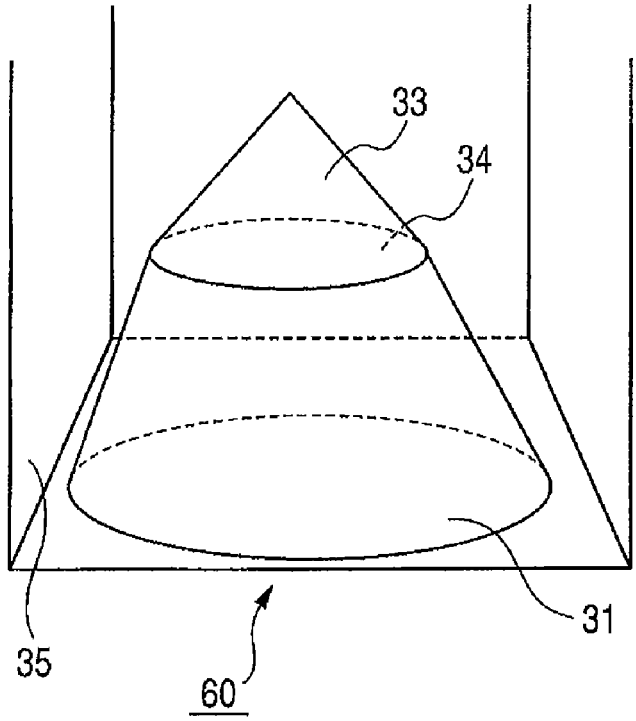
FIG. 22 is a perspective view through a frame which illustrates a modified example of a waste-ink-collecting unit according to Example 6 of FIG. 20.

The sucked waste ink was drained dropwise onto the top part of a transfer member 33 through a sucking tube 7. The sucked waste ink was further drained dropwise onto a slope of an ink absorbing member 31 through the surface of the transfer member 33. The surface of the transfer member 33 can be treated to be water repellent, in this case as well. Such a recovery operation was repeated and the ink absorbing member 31 was observed. Then, the waste ink (mixed ink) 45 was separated into a solid part 41 and a liquid part 42, and was retained by the ink absorbing member (FIG. 22). In addition, in the present Example, a deposit of the solid part 41 moved toward a lower part of the ink absorbing member 31, in comparison with Example 5, as is illustrated in FIG. 21.

FIG. 22 is a perspective view through a frame 35 which illustrates a modified example of a waste-ink-collecting unit 60 according to Example 6 of FIG. 20. FIG. 22 illustrates a structure which eliminates a bar-type protruding portion 36 in a central part of a structure in FIG. 20, bonds an ink absorbing member 31 having a conical shape with a flat top to the bottom surface of the frame 35, and bonds a transfer member 33 with a conical shape to the top surface of the ink absorbing member. The ink absorbing member 31 is bonded to the transfer member 33 through a contact surface 34. In this case as well, both of the transfer member 33 and the ink absorbing member 31 have each slope outspreading toward a lower part. These slopes may have the same angle or different angles. In an Example illustrated in the figure, both slopes are connected. In some cases, both slopes may be formed so as not to be connected by forming the upper end surface of the ink absorbing member 31 in FIGS. 20 and 22 so as to have a smaller area than that of the bottom end surface of the transfer member 33.

Example 7

Figure 23:
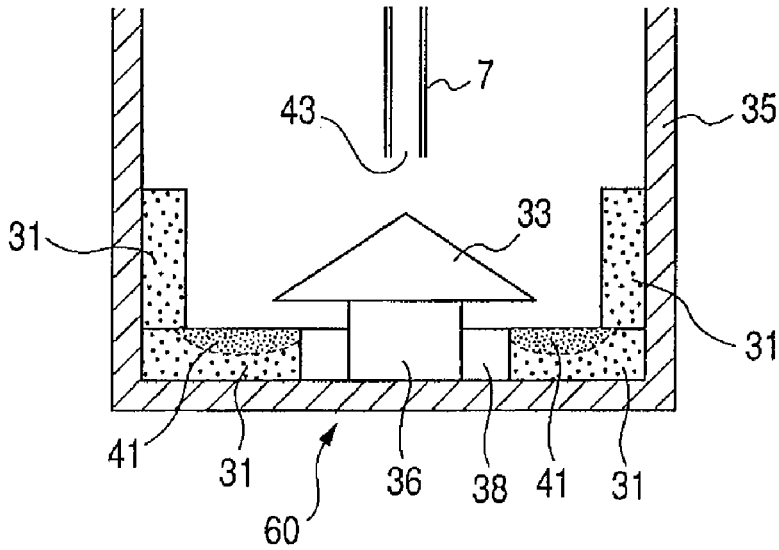
FIG. 23 is a longitudinal sectional view illustrating a state before waste ink is drained dropwise in Example 7 of a waste-ink-collecting unit in an ink jet recording apparatus according to a second embodiment in the present invention.
Figure 24:
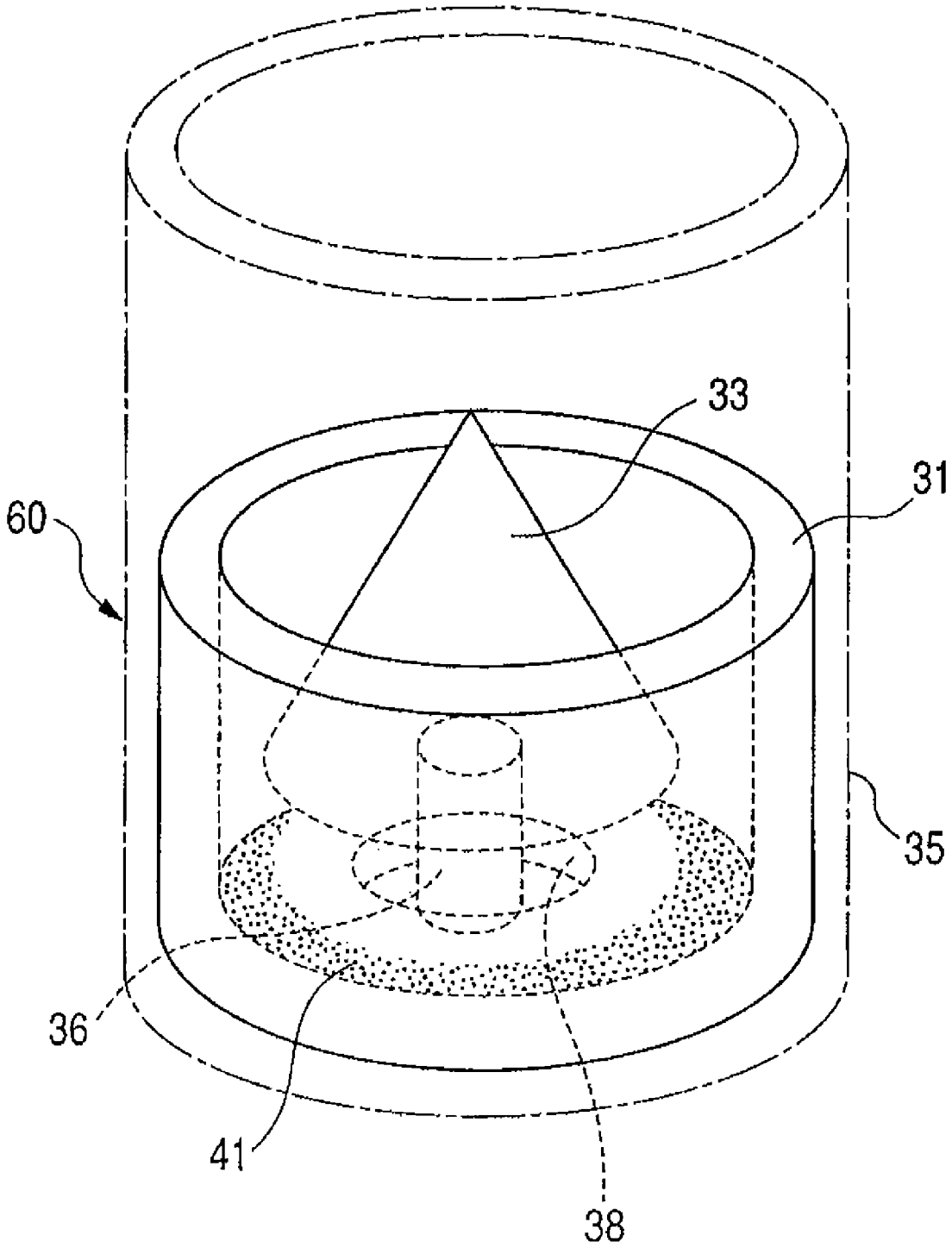
FIG. 24 is a perspective view through a frame which illustrates a state of an ink absorbing member and a transfer member in a waste-ink-collecting unit illustrated in FIG. 23, after waste ink has been drained dropwise.

FIG. 23 is a longitudinal sectional view illustrating a state before waste ink is drained dropwise in Example 7 of a waste-ink-collecting unit 60 in an ink jet recording apparatus according to a second embodiment. FIG. 24 is a perspective view through a frame 35 which illustrates a state of an ink absorbing member 31 and a transfer member 33 in a waste-ink-collecting unit 60 illustrated in FIG. 23, after waste ink has been drained dropwise. In the present Example, the waste ink was drained dropwise onto the transfer member 33 through a sucking tube 7 with the use of the transfer member 33 and the ink absorbing member 31 as illustrated in FIG. 23, similarly to the case of Example 1.

The present Example has a feature of arranging an ink absorbing member 31 so as to surround a transfer member 33 (and protruding portion 36). Specifically, a waste-ink-collecting unit has a structure of accommodating the ink absorbing member 31 with a recessed shape having an opening 38 in a central part and having an opened upper end along an inner wall surface and the bottom surface of a frame 35, and arranging the transfer member 33 in the center of the opening 38. In the present Example as well, when a recovery operation was repeated and the ink absorbing member 31 was observed, the waste ink drained dropwise was separated into a solid part 41 and a liquid part 42, and was retained by the ink absorbing member 31. In addition, a waste-ink-collecting unit in the present Example has a structure of hardly leaking a deposit of the solid part 41 to the outside of a recording apparatus in comparison with that in Example 5, because the transfer member 33 is surrounded by the cylindrical ink absorbing member 31.

In the above described second embodiment as well, a capability of inhibiting bleeding on a recording image was evaluated which is specifically a capability of reducing bleeding or color mixture on an image recorded by printing a black line on the backdrop of a solid printing of yellow, with the use of a black ink 1 and a yellow ink 1. As a result of this, both of Examples showed extremely satisfactory capability.

An ink jet recording apparatus according to the above described second embodiment has a structure of transferring a mixed ink of pigment ink drained from a discharge portion of black ink and a dye ink which has been drained from a color ink discharge portion and has reactivity with the pigment ink, onto an ink absorbing member through a transfer member; and being capable of vaporizing water of the mixed ink on the ink absorbing member. As a result of this, the ink jet recording apparatus can separate the drained ink into a solid part of a pigment and a liquid part of a dye, on the ink absorbing member. Accordingly, the ink jet recording apparatus can keep an adequate absorptivity of the ink absorbing member 31 of a waste-ink-collecting unit 60 for a long period of time, even when recording an image of high quality free from blur by reacting black ink with color ink to make them solidified or thickened when recording the image.

An ink-jet recording apparatus described as an example in the above embodiment was a serial type which uses a recording head that is carried by a carriage and moves along a recording medium. The present invention can be also similarly applied to an ink-jet recording apparatus of a line type which records an image only by vertically scanning a recording head for full-line recording. The present invention also can be similarly applied to any ink-jet recording apparatus regardless of the number of recording heads, and of the number of types and properties of the ink, and shows a similar operation/working-effect. Furthermore, the present invention is not limited to a unit device such as a printer, a copying machine, a facsimile and an image-forming device. The present invention can be widely applied to a combined apparatus like a composite apparatus which combines the above unit devices, or a recording apparatus in a computer system, and shows a similar operation/working-effect.

While the present invention has been described with reference to Examples, it is to be understood that the invention is not limited to the disclosed Examples. The scope of the following claims is to be accorded the broadest interpretation so as to encompass all such modifications and equivalent structures and functions.

This application claims the benefit of Japanese Patent Application No. 2006-170977, filed Jun. 21, 2006, which is hereby incorporated by reference herein in its entirety.

What is claimed is:

1. An ink jet recording apparatus for recording an image by discharging ink to a recording medium from a recording head on the basis of image information comprising:

a recovery unit for draining the ink from a black-ink discharge portion for discharging black ink and a color-ink discharge portion for discharging color ink which reacts with the black ink;

an ink absorbing member for collecting the ink which is drained by the recovery unit and separating the ink into a solid part and a liquid part;

an ink introduction unit for introducing both of the black-ink and the color-ink which is drained by the recovery unit, into the ink absorbing member; and a transfer member which does not absorb the ink introduced by the ink introduction unit directly, but transfers both of the black ink and the color-ink to the ink absorbing member, wherein the transfer member is separately arranged below an outlet of the ink introduction unit.

2. The ink jet recording apparatus according to claim 1, further comprising a waste-ink-collecting unit which is the ink absorbing member accommodated in a frame.

3. The ink jet recording apparatus according to claim 2, wherein the transfer member and the frame are made from a same material.

4. The ink jet recording apparatus according to claim 1, wherein the transfer member has an upwardly convexed shape.

5. The ink jet recording apparatus according to claim 1, wherein the transfer member has a triangular cross section.

6. An ink jet recording apparatus for recording an image by discharging ink to a recording medium from a recording head on the basis of image information comprising:

a recovery unit for draining the ink from a black-ink discharge portion for discharging black ink and a color-ink discharge portion for discharging color ink which reacts with the black ink;

an ink absorbing member for collecting the ink which is drained by the recovery unit and separating the ink into a solid part and a liquid part;

an ink introduction unit for introducing both of the black-ink and the color-ink which is drained by the recovery unit, into the ink absorbing member; and a transfer member which does not absorb the ink introduced by the ink introduction unit directly, but transfers both of the black-ink and the color-ink to the ink absorbing member, wherein the ink absorbing member is arranged in a lower part of the transfer member.

7. An ink jet recording apparatus for recording an image by discharging ink to a recording medium from a recording head on the basis of image information comprising:

a recovery unit for draining the ink from a black-ink discharge portion for discharging black ink and a color-ink discharge portion for discharging color ink which reacts with the black ink;

an ink absorbing member for collecting the ink which is drained by the recovery unit and separating the ink into a solid part and a liquid part;

an ink introduction unit for introducing both of the black-ink and the color-ink which is drained by the recovery unit, into the ink absorbing member; and a transfer member which does not absorb the ink introduced by the ink introduction unit directly, but transfers both of the black-ink and the color-ink to the ink absorbing member, wherein the transfer member is treated to be water repellent.

8. The ink jet recording apparatus according to claim 1, wherein the ink absorbing member is separately arranged below an outlet of the ink introduction unit.

9. The ink jet recording apparatus according to claim 1, wherein the ink absorbing member has a slope which outspreads toward a lower part.

10. The ink jet recording apparatus according to claim 1, wherein the ink absorbing member has an arc-shaped cross section.

11. The ink jet recording apparatus according to claim 8, wherein the ink absorbing member makes its part below an outlet lower than the other part of the ink absorbing member.

12. The ink jet recording apparatus according to claim 1, wherein the black ink is a pigment ink and the color ink is a dye ink.

* * * * *